US006346926B1

(12) United States Patent
Shimabara et al.

(10) Patent No.: US 6,346,926 B1
(45) Date of Patent: Feb. 12, 2002

(54) HELICAL ANTENNA

(75) Inventors: Masataka Shimabara, Warabi; Yutaka Izumi; Takashi Nakaya, both of Kounosu, all of (JP)

(73) Assignee: Nippon Antena Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/697,141

(22) Filed: Oct. 27, 2000

(30) Foreign Application Priority Data

Oct. 29, 1999 (JP) ..... 11-308771

(51) Int. Cl.[7] ..... H01Q 1/36

(52) U.S. Cl. ..... 343/895

(58) Field of Search ..... 343/895, 715, 343/749, 702; H01Q 1/36

(56) References Cited

U.S. PATENT DOCUMENTS 6,239,768 B1 * 5/2001 Oh et al. ..... 343/895

* cited by examiner

*Primary Examiner*—Michael C. Wimer
(74) *Attorney, Agent, or Firm*—Connolly Bove Lodge & Hutz

(57) ABSTRACT

Helical protrusion portions are formed on a peripheral side surface face of a bobbin, and a helical element is screwed into the helical grooves formed between the helical protrusion portions. The lower end of the bobbing is screwed onto an attachment fitting provided with a first collar portion at an intermediate portion and a second collar portion at the end. The depth of the helical groove portions becomes gradually shallower toward the leading end of the helical protrusion portions, and the helical protrusion portions formed on the lower end of the bobbin are formed higher, so that the position of the helical element is stabilized. Thus, deviation of the resonance point of the helical element can be prevented.

4 Claims, 11 Drawing Sheets

ANNULUS
E
100
104
106
108
110
112
114
116
118
124
129
140
142
144
146
148
150
151
152
153
154
155
156
158
160
162
164
166
168
170
172
174
176
178
180
182
184
186
188
190
192
194
202
206
208
210
234
236
238
238A
260
40
42

ANNULUS
E
100
102
104
106
108
110
112
114
116
118
124
129
140
142
144
146
148
150
151
152
153
154
155
156
158
160
162
164
166
168
170
172
174
176
178
180
182
184
186
188
190
192
194
202
206
208
210
234
236
238
2384
260
40
42

ANNULUS
E

HELICAL ANTENNA

BACKGROUND OF THE INVENTION

1. Field of the Invention

Recently, mobile telephones for cellular systems and simple mobile phone systems (PHS) have become widely popular, and these mobile telephones are provided with antennas for the transmission and reception of call traffic and data traffic. Usually, for these antennas, a whip antenna is used, which is made of a retractable whip element that, for the sake of convenience when carrying the mobile telephone and anticipating a call, can be stowed away in a casing of the mobile telephone.

2. Description of the Related Art

However, when the whip element has been stowed away in the casing, transmission and reception with the mobile telephone are almost impossible, so that a small antenna element has to be provided outside the casing when the whip element is stowed away in the casing. Thus, this small antenna element can be used for transmission and reception when the whip element is stowed away in the casing.

A characteristic feature of helical antennas is that the physical length can be made shorter than the effective antenna length, so that helical antennas are used for the afore-mentioned small antenna elements. Conventionally known are configurations, in which the helical antenna is provided at the casing of the mobile telephone, or at the tip of a retractable whip element.

The configuration of such a conventional helical antenna is shown in FIGS. 10*a* and 10*b*. However, the helical antenna 100 shown in these drawings is of the type that is attached to the wireless device casing of a mobile telephone or the like, and the cover covering its outer surface is not shown.

FIG. 10*a* is a plan view of the helical antenna 100, and FIG. 10*b* is a cross-sectional view thereof. As shown in these drawings, a through hole 101*a* is formed in the insulating bobbin 101, which is made by resin casting, passing from the top to the bottom along the axis of the bobbin 101. The through hole 101*a* is provided for slidably inserting the whip antenna into it.

A single thread of helical protrusion portions 105 is formed on the peripheral outer surface of the bobbin 101. The helical protrusion portions 105 form a single thread, but for illustrative reasons, the numerals 105*a* to 105*g* are associated with the helical protrusion portions in FIGS. 10*a* and 10*b*. The helical protrusion portion 105*g* is taken as the leading end of the helical protrusion portions 105. The helical protrusion portions 105*a* to 105*g* form helical groove portions between them, and a helical element 122 is arranged in these helical groove portions. The helical element 122 is made of a wire of, for example, phosphor bronze, which is formed into helical shape. The helical element 122 is screwed from the upper end of the bobbin 101 into the helical groove, which leads to the situation shown in FIGS. 10*a* and 10*b*.

The lower end of the bobbin 101 is provided with a threaded portion, and this threaded portion of the bobbin 101 is screwed into a threaded portion formed on an inner peripheral surface at the upper end of an attachment fitting 115. This fixes the attachment fitting 115 to the lower end of the bobbin 101. The lower portion of the helical element 122 that has been screwed onto the bobbin 101 is also wound around an upper cylindrical portion 115*d* formed in the upper portion of the attachment fitting 115, and the helical element 122 is in electrical contact with this upper cylindrical portion 115*d*. Furthermore, a through hole 115*a* connected to the through hole 101*a* is formed also in the attachment fitting 115. A collar portion 115*b* is formed in an intermediate portion of the peripheral side surface of the attachment fitting 115, and a threaded portion 115*c* is formed at a lower portion of the peripheral side surface. The threaded portion 115*c* is screwed to the wireless device casing until the lower surface of the collar portion 115*b* abuts against the wireless device casing, whereby the helical antenna 100 is attached to the wireless casing device. Thus, the attachment portion 115 connects the transmission/reception portion provided inside the wireless device casing with the helical element 122.

The helical antenna 100 with the conventional configuration shown in FIGS. 10*a* and 10*b* has a small outer diameter of several mm, so that the helical element 122 is provided with a wire diameter of about 0.6 mm. When this helically shaped helical element 122 is screwed from the upper end of the bobbin 101, it will be moved beyond the helical protrusion portion 105*g*, or the leading end and wound around the upper cylindrical portion 115*d*. Thus, the inner peripheral surface of the helical element 122 will be brought into contact with the upper cylindrical portion 115*d*. However, since the wire diameter of the helical element 122 is small, as mentioned above, and the screwing is performed manually, already small differences in the screwing force can lead to a vertical displacement of the position of the helical element 122 contacting the upper cylindrical portion 115*d*. Thus, when the position of the helical element 122 contacting the upper cylindrical portion 115*d* is shifted vertically, there are the problems that the effective number of windings of the helical element 122 changes, and the resonance frequency of the helical antenna 100 shifts.

This is explained with reference to FIGS. 11*a*, 11*b*, and 11*c*. As shown in FIG. 11*a*, the helical element 122*g* is in contact with the upper cylindrical portion 115*d*. The helical element 122*g* and the upper cylindrical portion 115*d* contact each other at the contact point 123 located on the right side in FIG. 11*a*. When the position of the helical element 122*g* is shifted slightly upwards as shown in FIG. 11*b*, then the helical element 122*g* and the upper cylindrical portion 115*d* contact each other at the contact point 123 located approximately at the center as shown in FIG. 11*b*. Furthermore, when the position of the helical element 122*g* is shifted even more upwards as shown in FIG. 11*c*, then the helical element 122*g* and the upper cylindrical portion 115*d* contact each other at the contact point 123 located on the left side in FIG. 11*c*. Thus, there is the problem that when the helical antenna 100 is used, for example, for the 900 MHz band, then this shifting of the contact point 123 causes a resonance shift of about 20 MHz for the shift shown in FIG. 11*b*, and a resonance shift of about 40 MHz for the shift shown in FIG. 11*c*.

It is therefore an object of the present invention to provide a helical antenna, in which the helical element and the attachment fitting contact one another at a stabilized location.

SUMMARY OF THE INVENTION

In a helical antenna in accordance with the present invention, a leading end of the helical protrusion portions formed at the lower end of the bobbin has substantially the same diameter as the second collar portion, which is connected to this leading end, and the depth of the helical groove portions becomes gradually shallower toward this leading end, so that the helical element can be easily moved beyond the leading end and positioned on the side surface of the second collar portion. Since the outer diameter of the second collar portion and the outer diameter of the leading end are substantially the same and there is almost no difference in level between them, the helical element is better prevented from shifting vertically, and the helical element contacts the side surface of the second collar portion of the attachment fitting at a stabilized location. Consequently, deviation of the resonance point can be prevented.

When the helical protrusion portions including the leading end, which form the helical groove portion whose depth becomes gradually shallower, are formed higher, then this helical groove portion becomes deeper, and the position of the helical element within this groove portion is stabilized, so that the position of the helical element at the border between the bobbin and the attachment fitting is stabilized, and the position where the helical element contacts the attachment fitting is stabilized even better.

Furthermore, when the helical groove portion in an upper portion of the bobbin breaks off, and the helical element is screwed onto the bobbin from below until the upper end surface of the helical element abuts against the abutting portion where the helical groove portion breaks off, the bobbin can be screwed into the attachment fitting. Then, when the bobbin is being screwed into the attachment fitting, the upper end surface of the helical element is fixed by abutting against the abutting portion, so that the position where the helical element contacts the attachment fitting is stabilized even better, and deviation of the resonance point can be prevented even better.

DESCRIPTION OF THE PREFERRED EMBODIMENTS

Figure 1A:
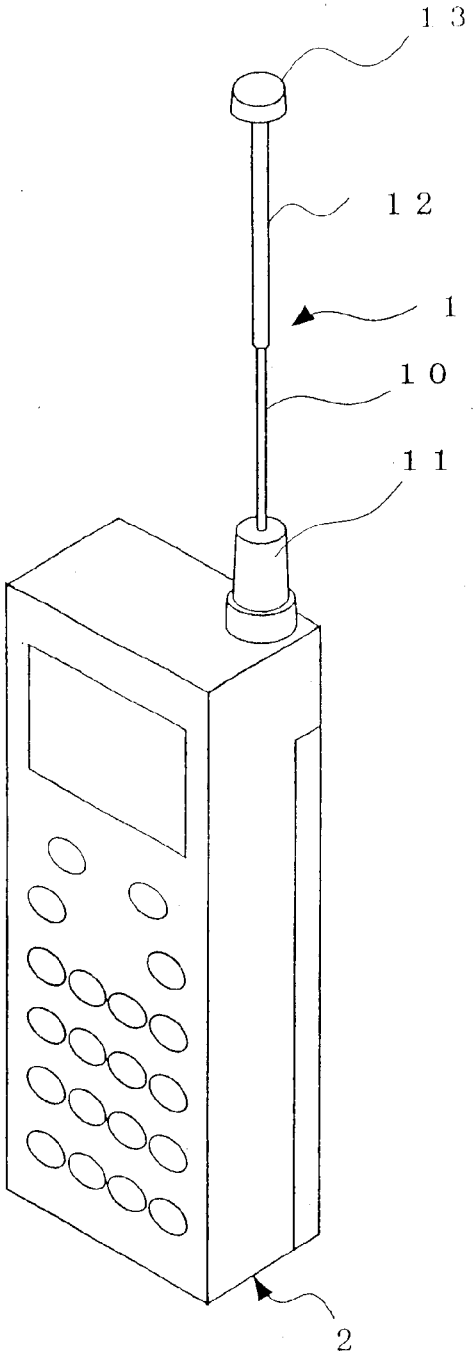
Figure 1B:
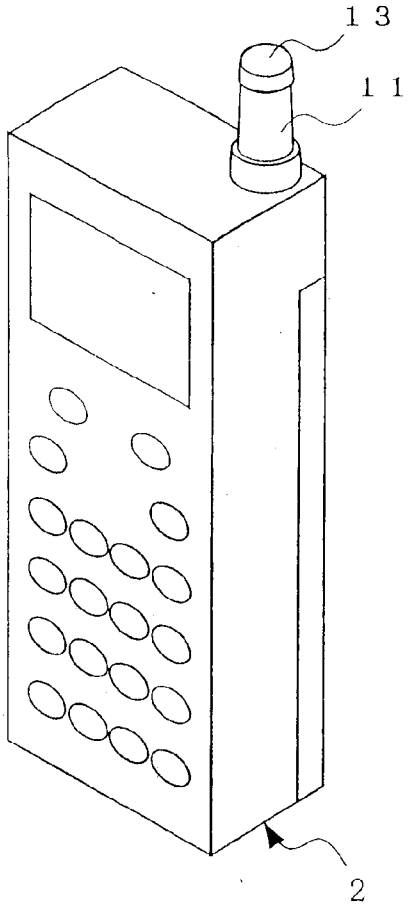

FIGS. 1*a* and 1*b* show an example of a configuration, in which a helical antenna in accordance with the present invention is attached as a helical antenna portion to the casing of a wireless device. This wireless device casing can be for example the casing of a mobile telephone.

The antenna 1 shown in FIGS. 1*a* and 1*b* includes a whip antenna portion 10 and a helical antenna portion 11 in accordance with the present invention. The whip antenna portion 10 penetrates the inside of the helical antenna 11 and is extendable/retractable with respect to the wireless device casing 2. FIG. 1*a* illustrates the situation as the whip antenna portion 10 is pulled out of the wireless device casing 2, and FIG. 1*b* illustrates the situation as the whip antenna portion 10 is stowed in the wireless device casing 2.

An elongated insulating joint portion 12 is formed integrally with the end of the whip antenna portion 10, and an antenna top 13, which is grasped when extending the whip antenna portion 10, is formed at the tip of the joint portion 12.

When the whip antenna portion 10 is extended as shown in FIG. 1*a*, the helical antenna portion 11 does not function as an antenna, because the whip antenna portion 10 is positioned inside the helical antenna portion 11, and the whip antenna portion 10 functions as an antenna. When the whip antenna portion 10 is stowed away as shown in FIG. 1*b*, the antenna top 13 abuts against the upper end of the helical antenna portion 11, and the insulating joint portion 12 is positioned inside the helical antenna portion 11. Thus, the helical antenna portion 11 functions as an antenna, whereas the whip antenna portion 10 does not function as an antenna, because the connection to the power supply portion is interrupted.

Thus, transmission and reception with the whip antenna portion 10 is possible when the whip antenna portion 10 is extended, and transmission and reception with the helical antenna portion 11 is possible when the whip antenna portion 10 is stowed away.

Figure 2A:
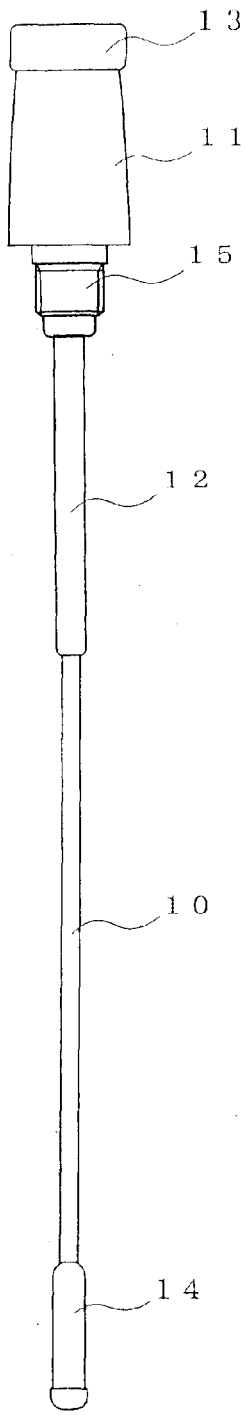
Figure 2B:
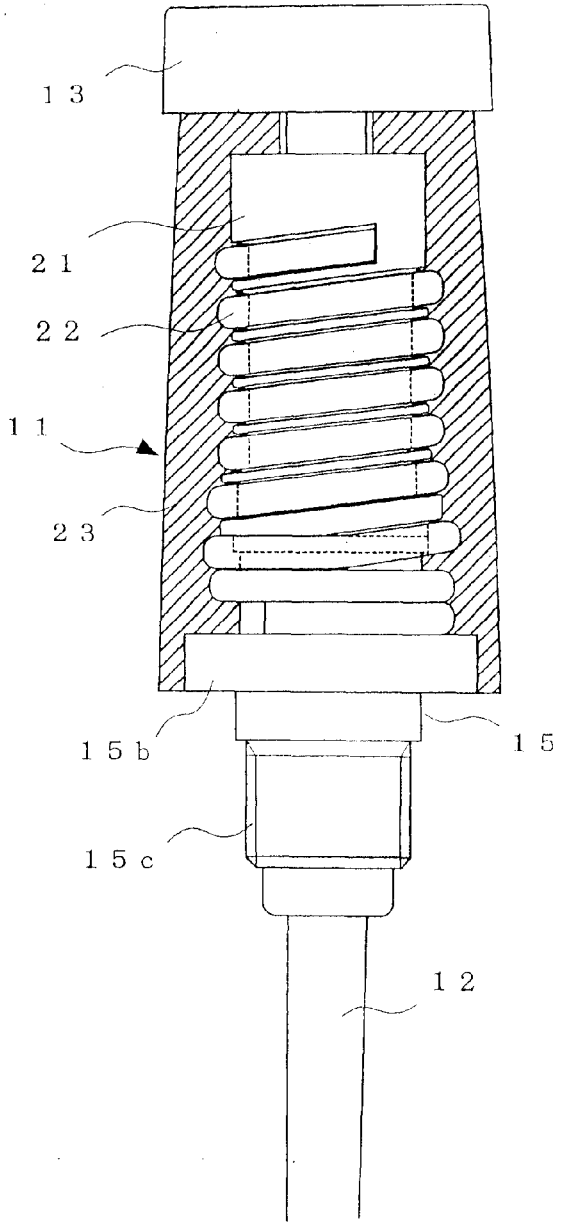
Figure 3:
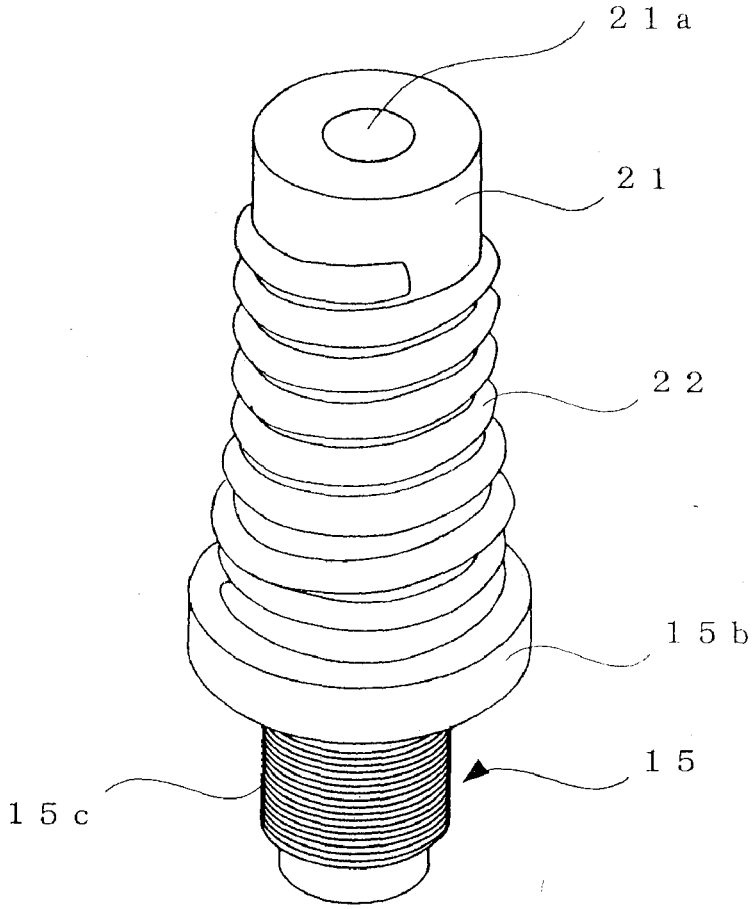
Figure 4A:
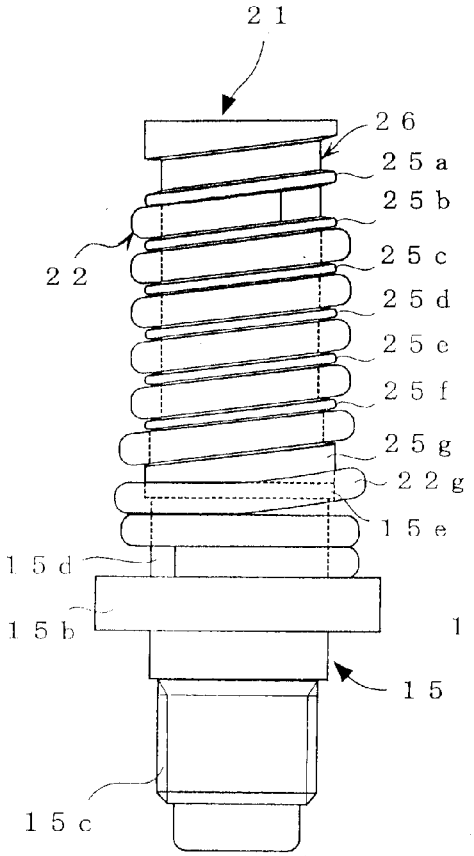
Figure 4B:
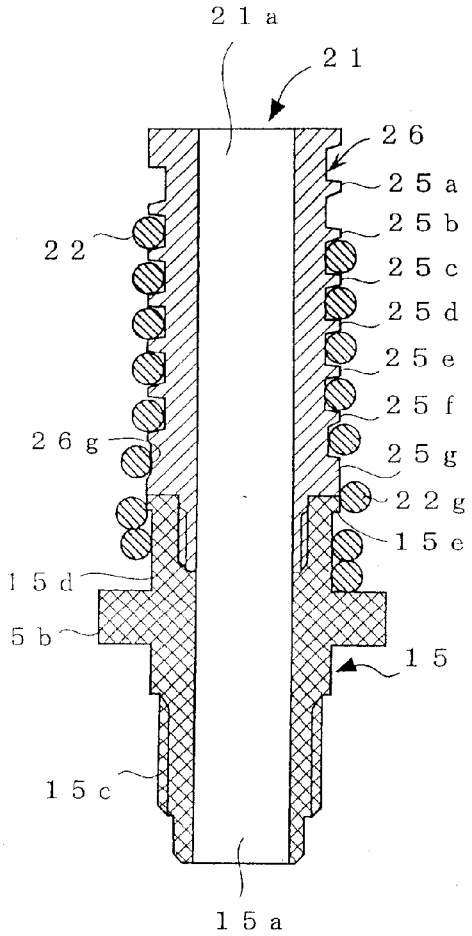

FIGS. 2*a* and 2*b* show the configuration of such an antenna 1 in detail. FIG. 2*a* shows the overall configuration of the antenna 1, and FIG. 2*b* is a cross-sectional view showing the configuration of a helical antenna portion 11 as an example of a helical antenna in accordance with the present invention.

FIG. 2*a* shows the situation when the whip antenna portion 10 is stowed away. A conductive stopper portion 14 is fit onto the lower end of the whip antenna portion 10. When the whip antenna portion 10 has been extended, this stopper portion 14 is fitted from below into an attachment fitting 15, and connects the whip antenna portion 10 electrically to the attachment fitting 15. When the whip antenna portion 10 is stowed away, the joint portion 12 is inserted into the helical antenna portion 11, so that the whip antenna portion 10 does not influence the helical antenna portion 11. In this situation, a helical element 22 accommodated inside the helical antenna portion 11 and connected to the attachment fitting 15 is connected by the attachment fitting 15 to a transmission/reception portion accommodated in the wireless device casing 2, which enables the transmission/reception portion to transmit and receive via the helical element 22.

As shown in FIG. 2*b*, the helical antenna portion 11 includes a bobbin 21 made of molded resin, a helical element 22 wound around the bobbin 21, a conductive attachment fitting 15 fixed to the lower end of the bobbin 21, and a cover 23 formed on the upper surface and the peripheral surface. A through hole is formed substantially through the center of the bobbin 21 and the attachment fitting 15, along the axis thereof. When the antenna is stowed away, as shown in the drawing, the joint portion 12 is inserted into this through hole. The helical element 22 that is wound around the bobbin 21 is wound beyond the bobbin 21 all the way to the upper portion of the attachment fitting 15, and the lower end of the helical element 22 abuts against the upper surface of a first collar portion 15*b* formed by the attachment fitting 15. The first collar portion 15*b* is formed at an intermediate portion of the attachment fitting 15, and a threaded portion 15*c* is formed at a portion below the collar portion 15*b*. The antenna 1 can be attached to the wireless device casing 2 by screwing the threaded portion 15*c* into the wireless device casing 2, whereby the lower surface of the first collar portion 15*b* abuts against the wireless device casing 2. This also connects the attachment fitting 15 to the transmission/reception portion.

Figure 1:
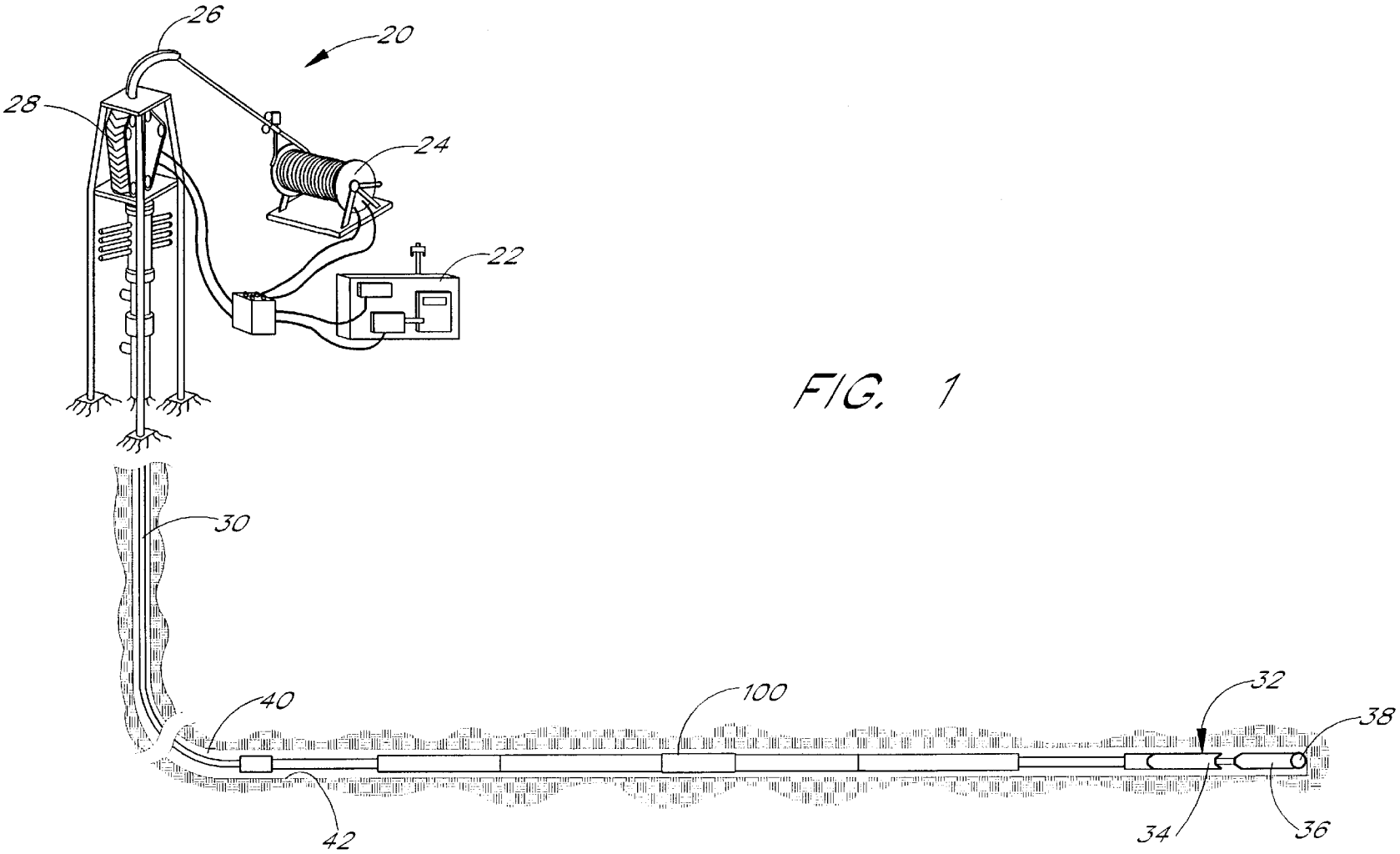
FIG. 1*a* shows a configuration, in which a helical antenna in accordance with the present invention is attached to a wireless device casing as a helical antenna portion, and the whip antenna portion is extended.
FIG. 1*b* shows a configuration, in which the whip antenna portion is stowed away.
Figure 2:
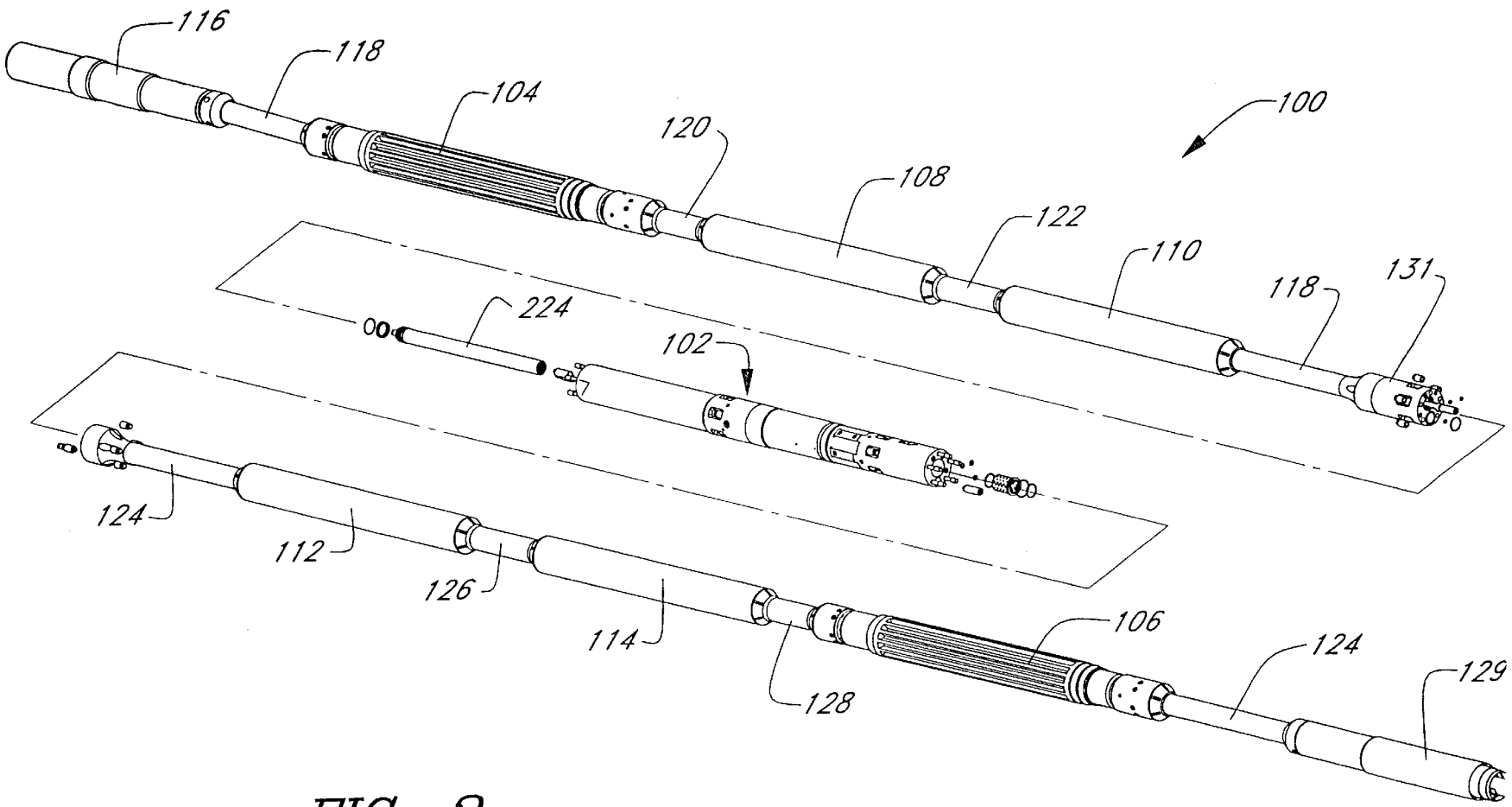
FIG. 2*a* is a plan view showing in detail the configuration of the antenna shown in FIGS. 1*a* and 1*b*.
FIG. 2*b* is a magnified cross-sectional drawing of a portion thereof.
Figure 3:
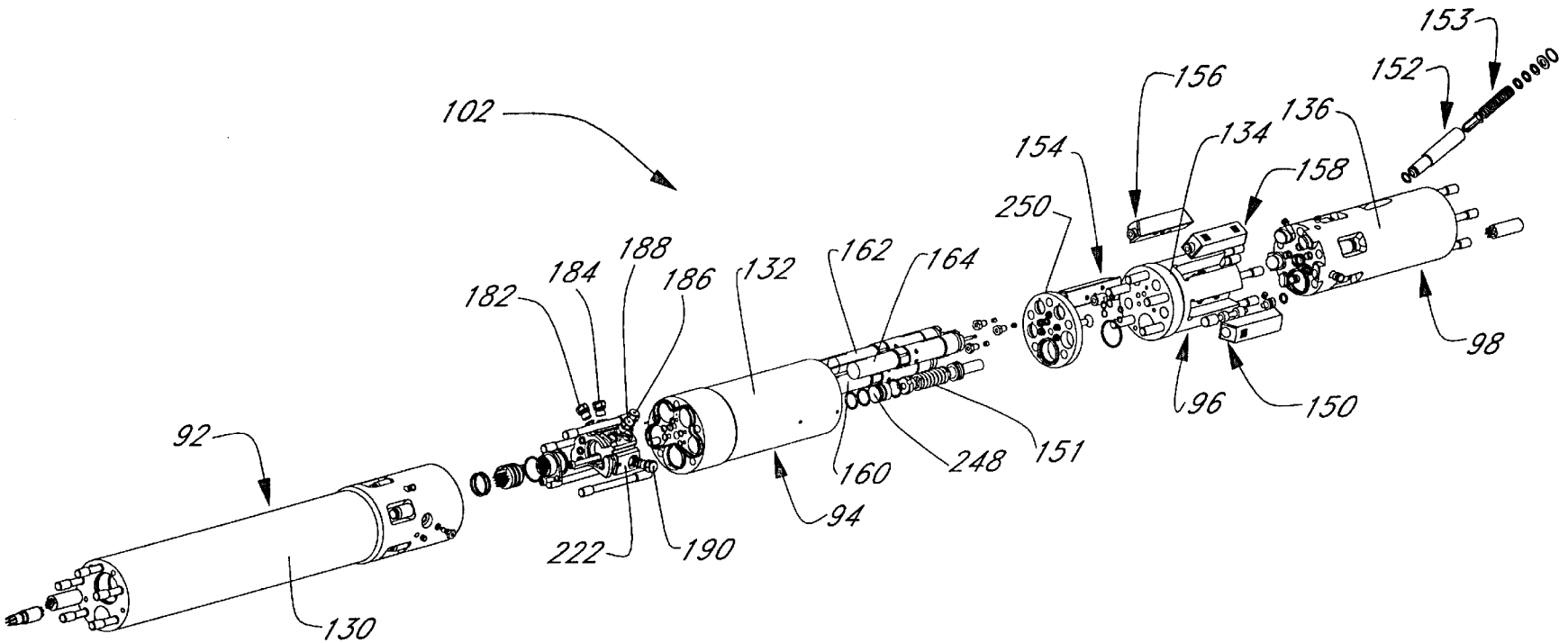
FIG. 3 is a perspective view showing the configuration of a helical antenna in accordance with the present invention.

FIG. 3 is a perspective view showing only the configuration of a helical antenna portion 11 in accordance with the present invention. However, the configuration in FIG. 3 is shown without the cover 23.

As shown in FIG. 3, the through hole 21*a* is formed substantially through the center of the bobbin 21 along the axis thereof, and the helical element 22 is wound around the peripheral side surface of the bobbin 21. The lower end of the helical element 22 abuts against the upper surface of the first collar portion 15*b* formed by the attachment fitting 15, and at the border between the bobbin 21 and the attachment portion 15, the helical element 22 is in contact and electrically connected with the attachment fitting 15. Below the first collar portion 15*b*, the attachment fitting 15 is provided with a threaded portion 15*c* for fixing the antenna 1.

Figure 4A:
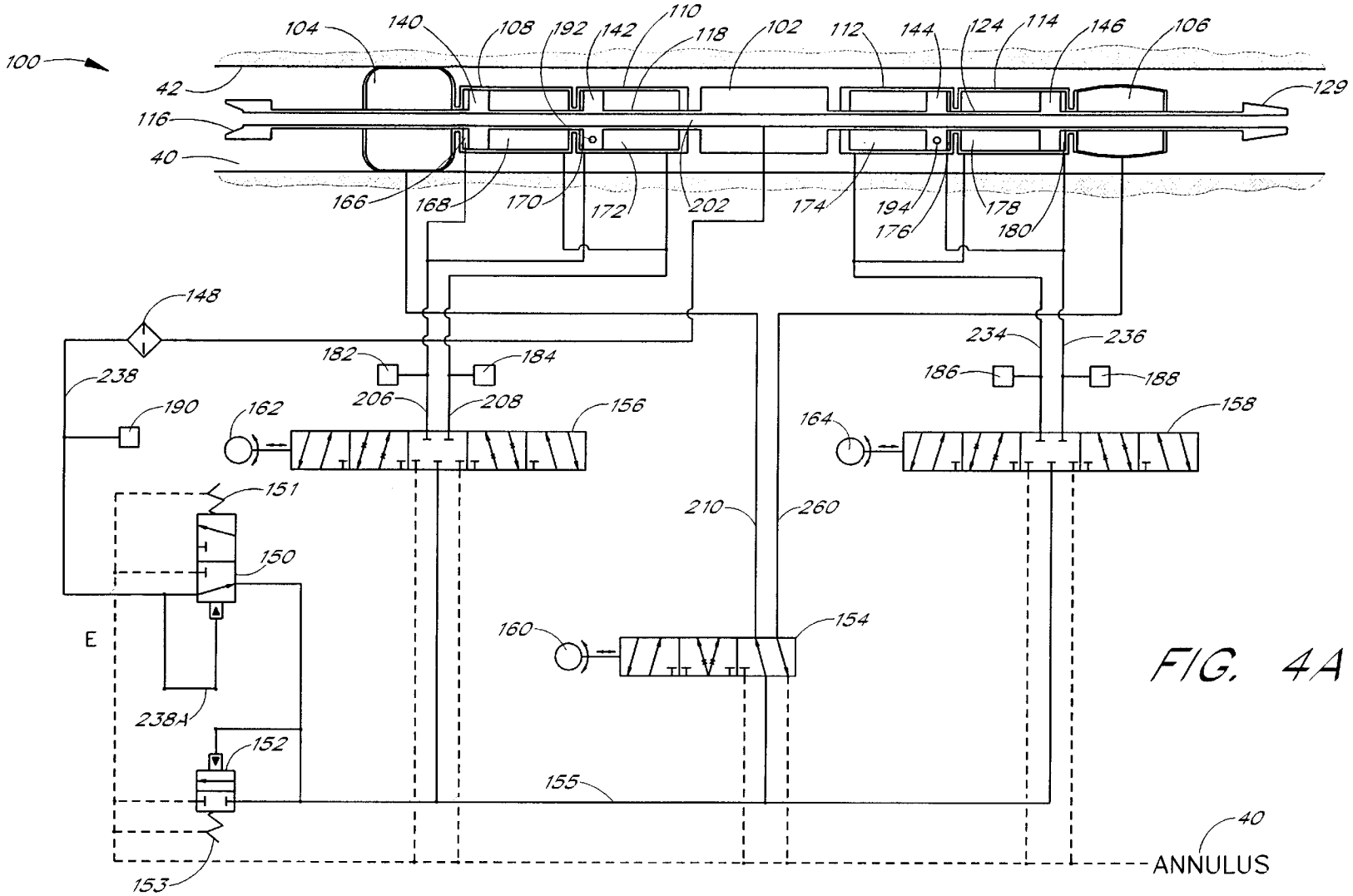
FIG. 4*a* is a plan view showing the configuration of the helical antenna in a first embodiment of the present invention.
Figure 4B:
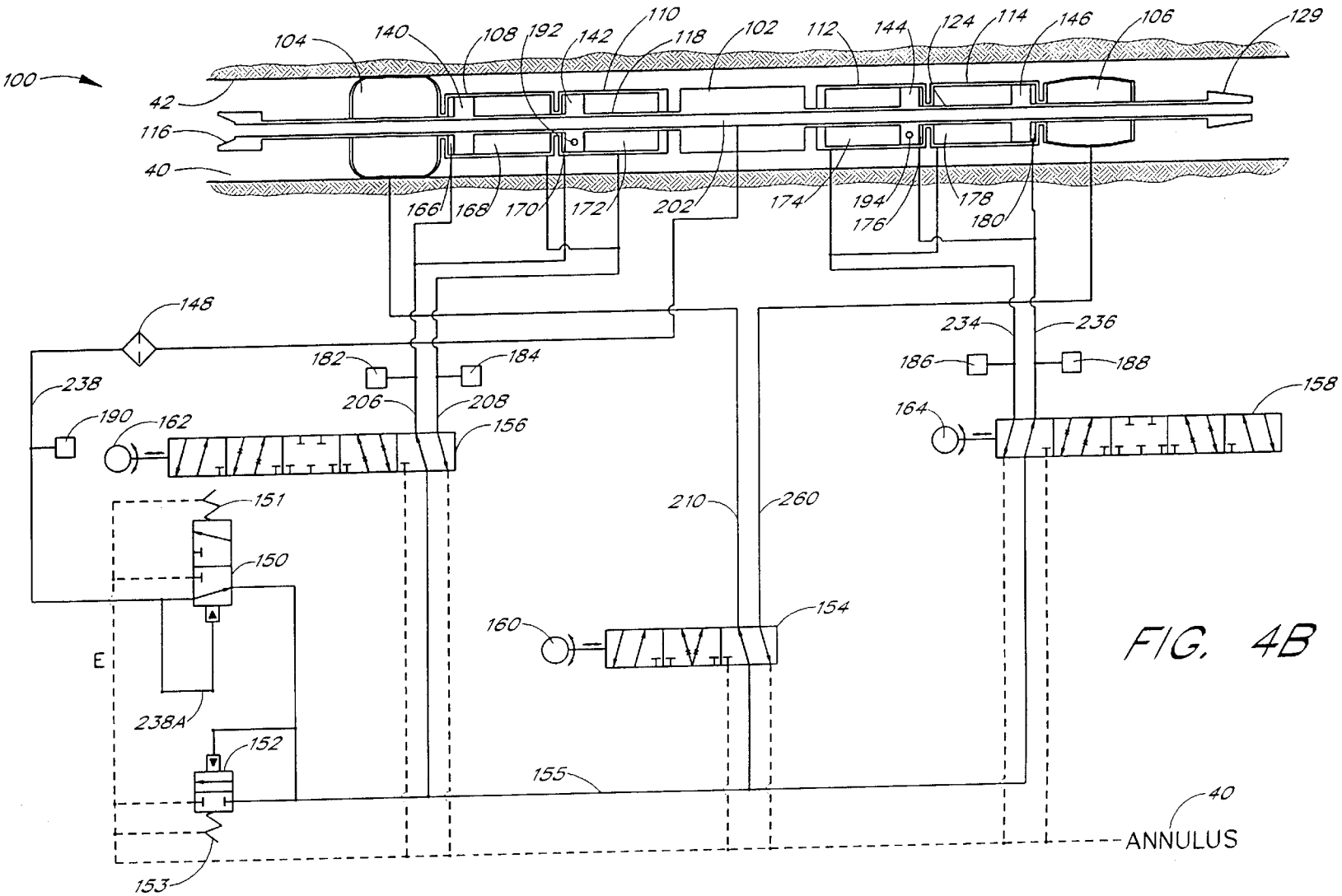
FIG. 4*b* is a cross-sectional view thereof.
Figure 4C:
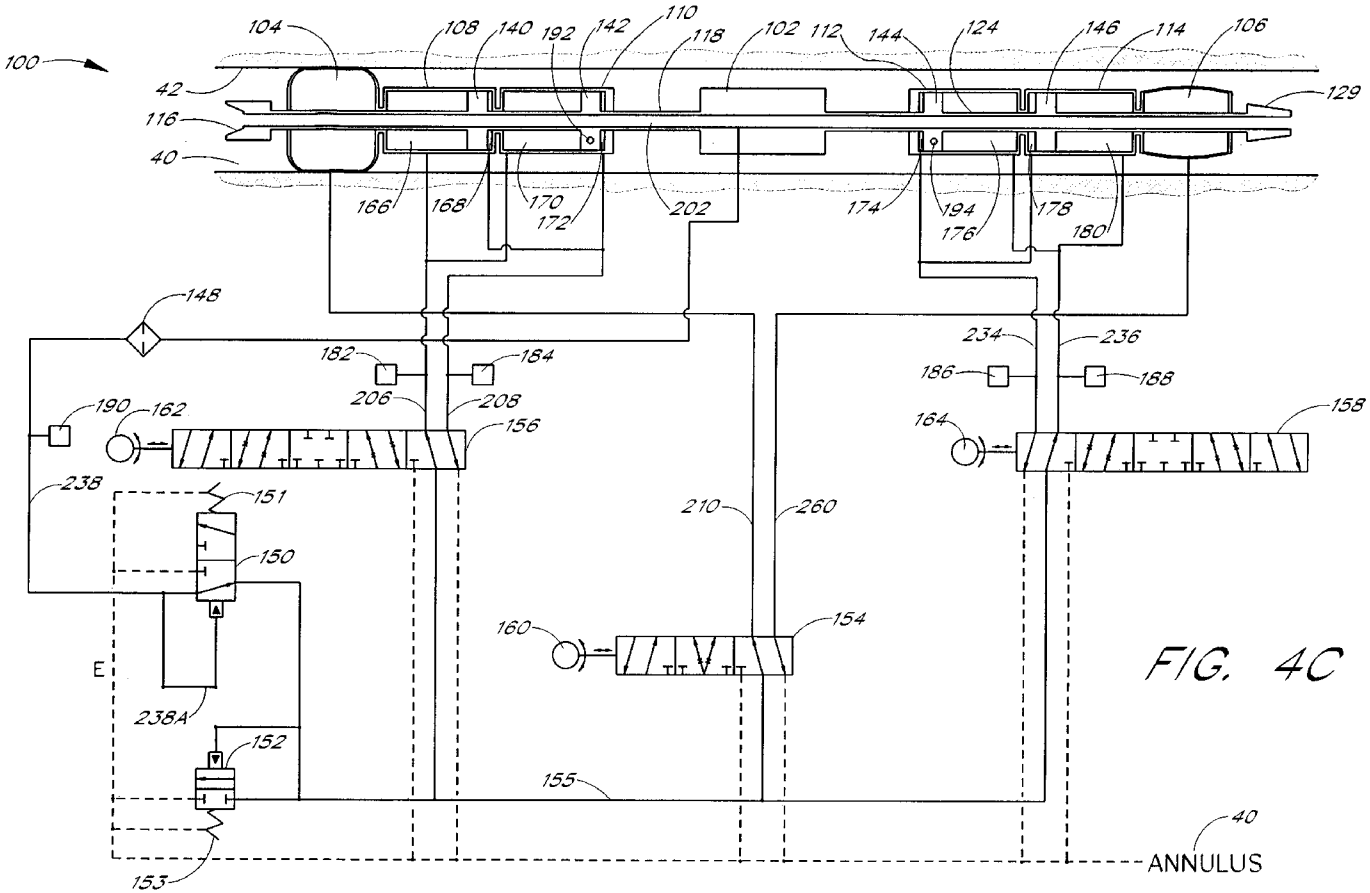
Figure 4D:
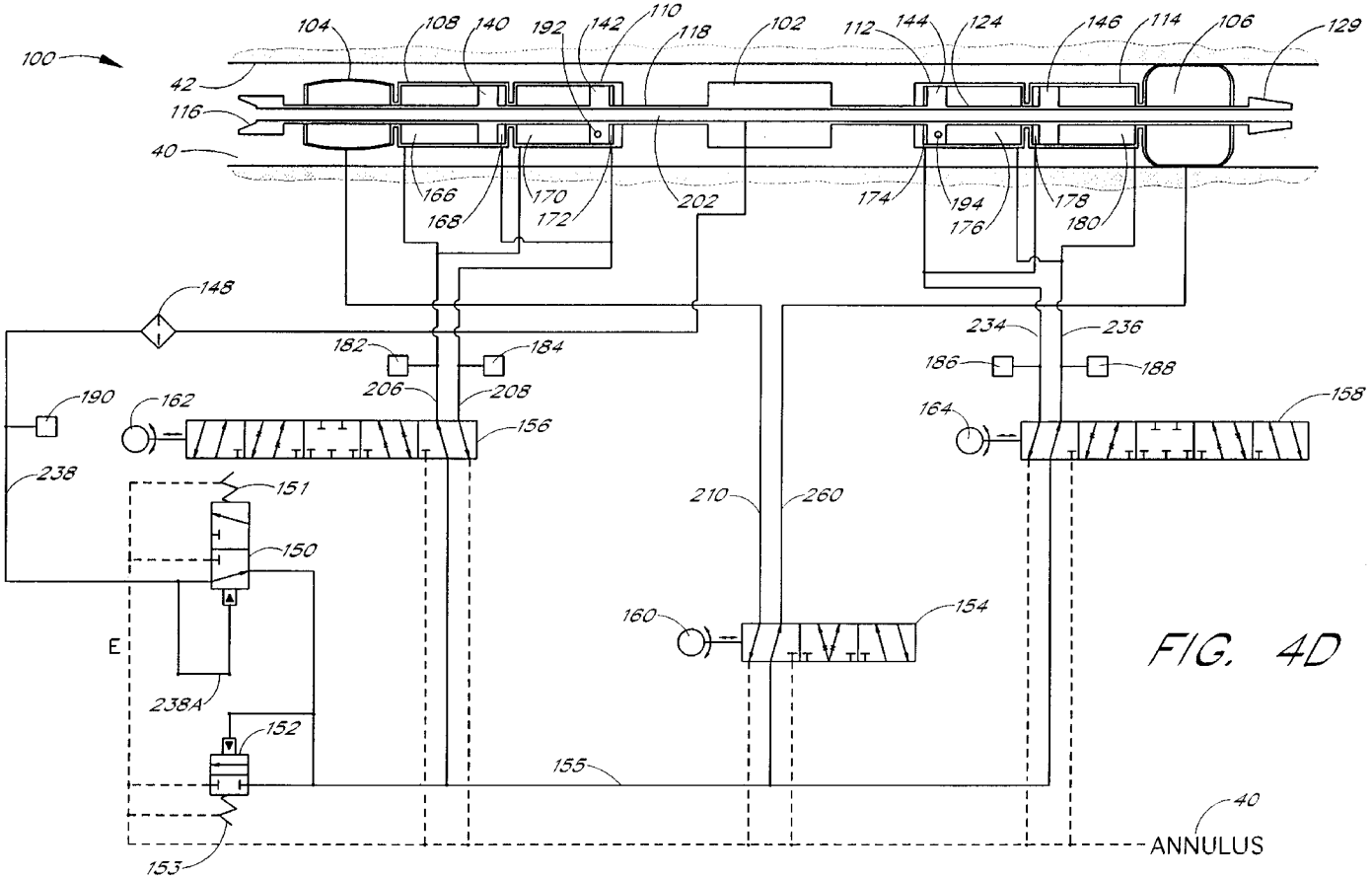
Figure 4E:
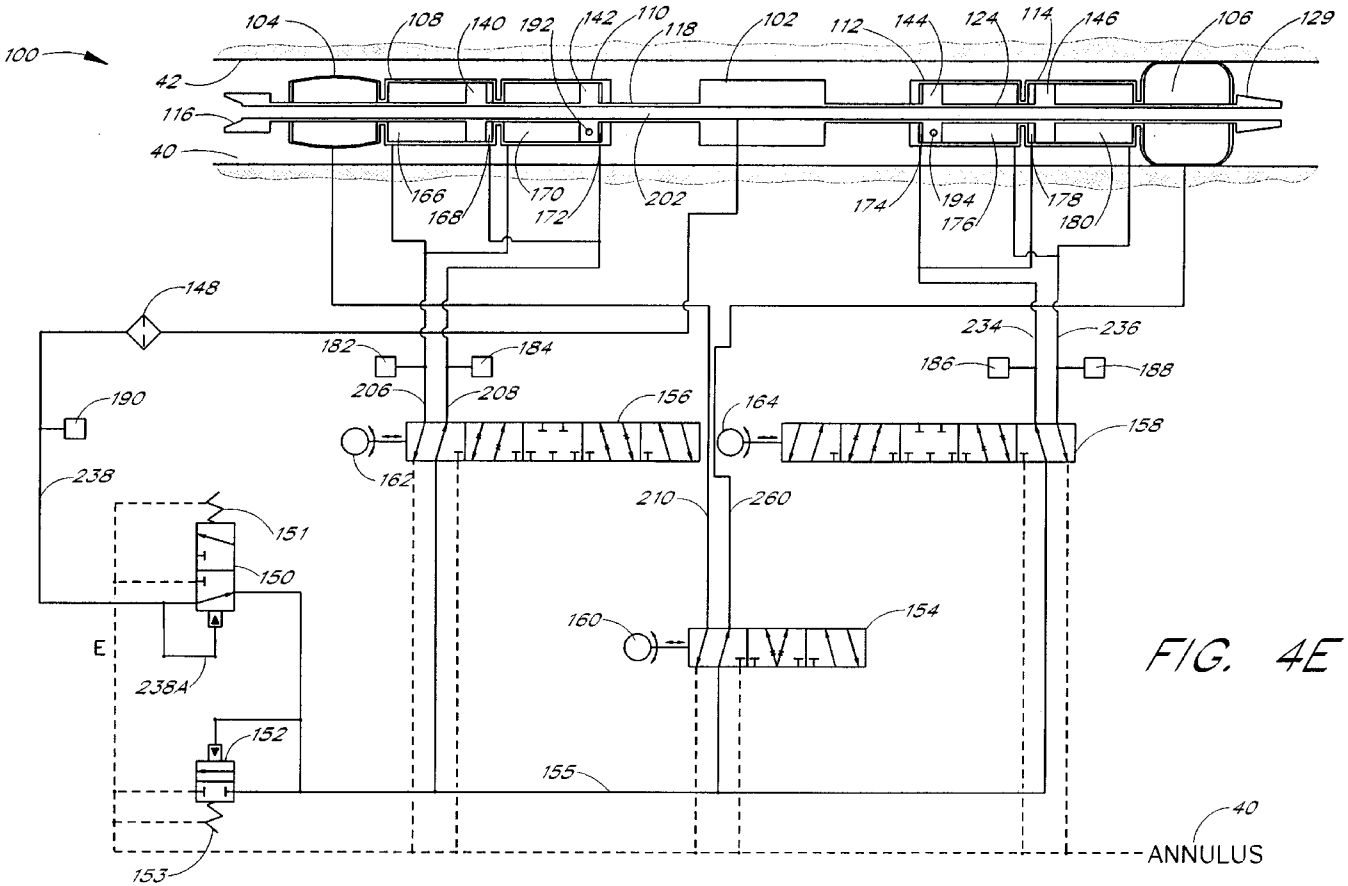
Figure 4F:
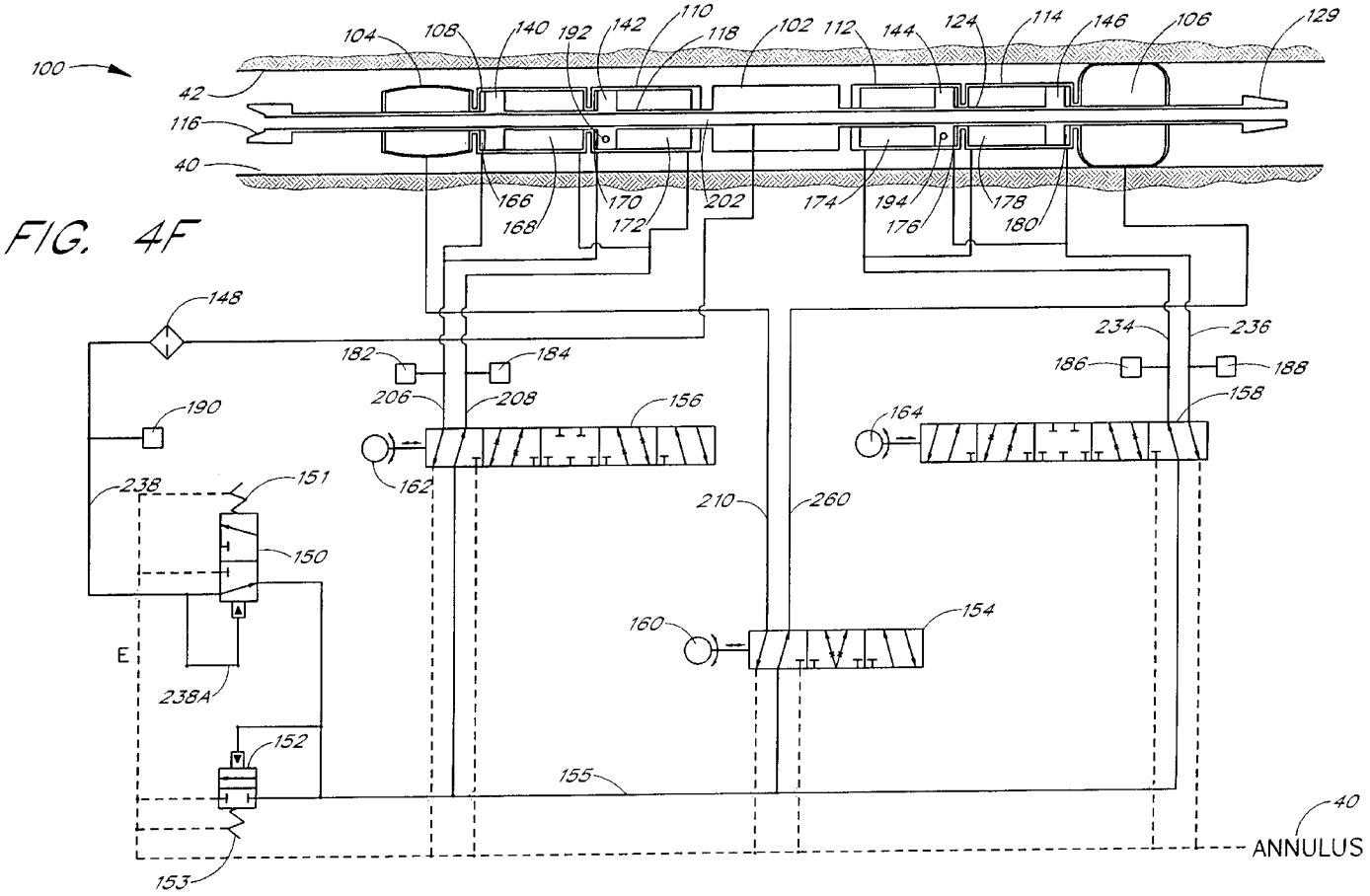
Figure 10A:
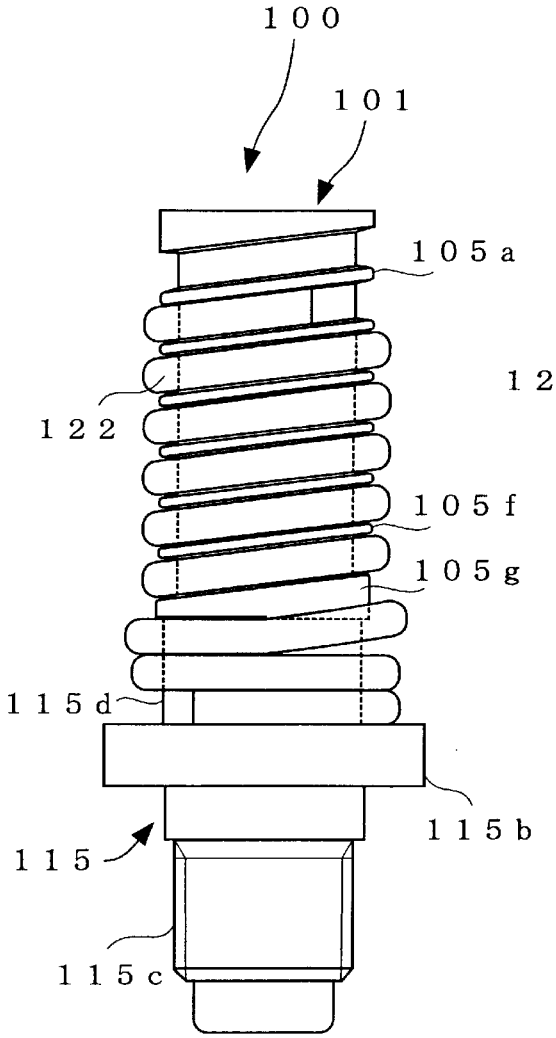
FIG. 10*a* is a plan view of the configuration of a conventional helical antenna.
Figure 10B:
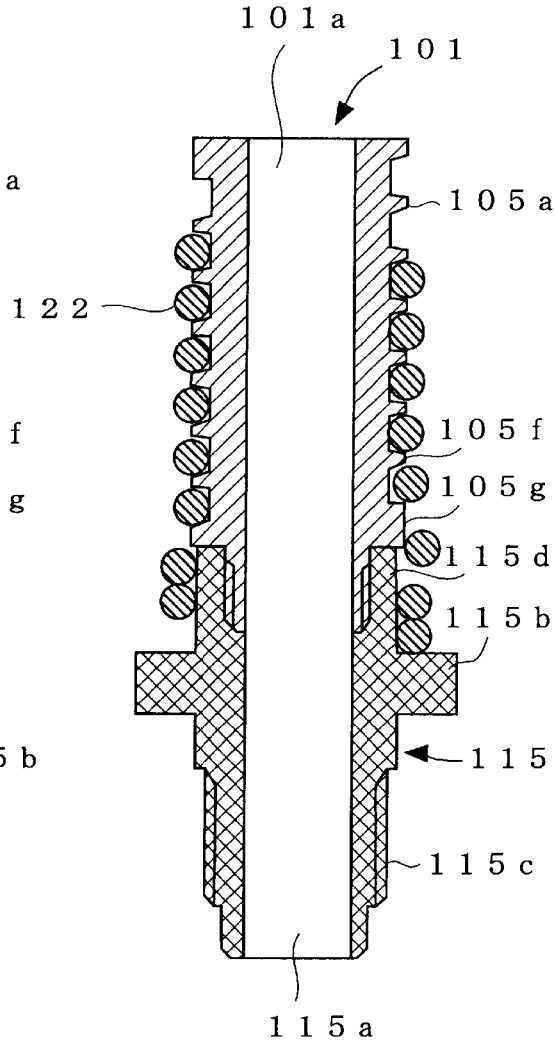
FIG. 10*b* is a cross-sectional view thereof.
Figures 11A, 11B, 11C:
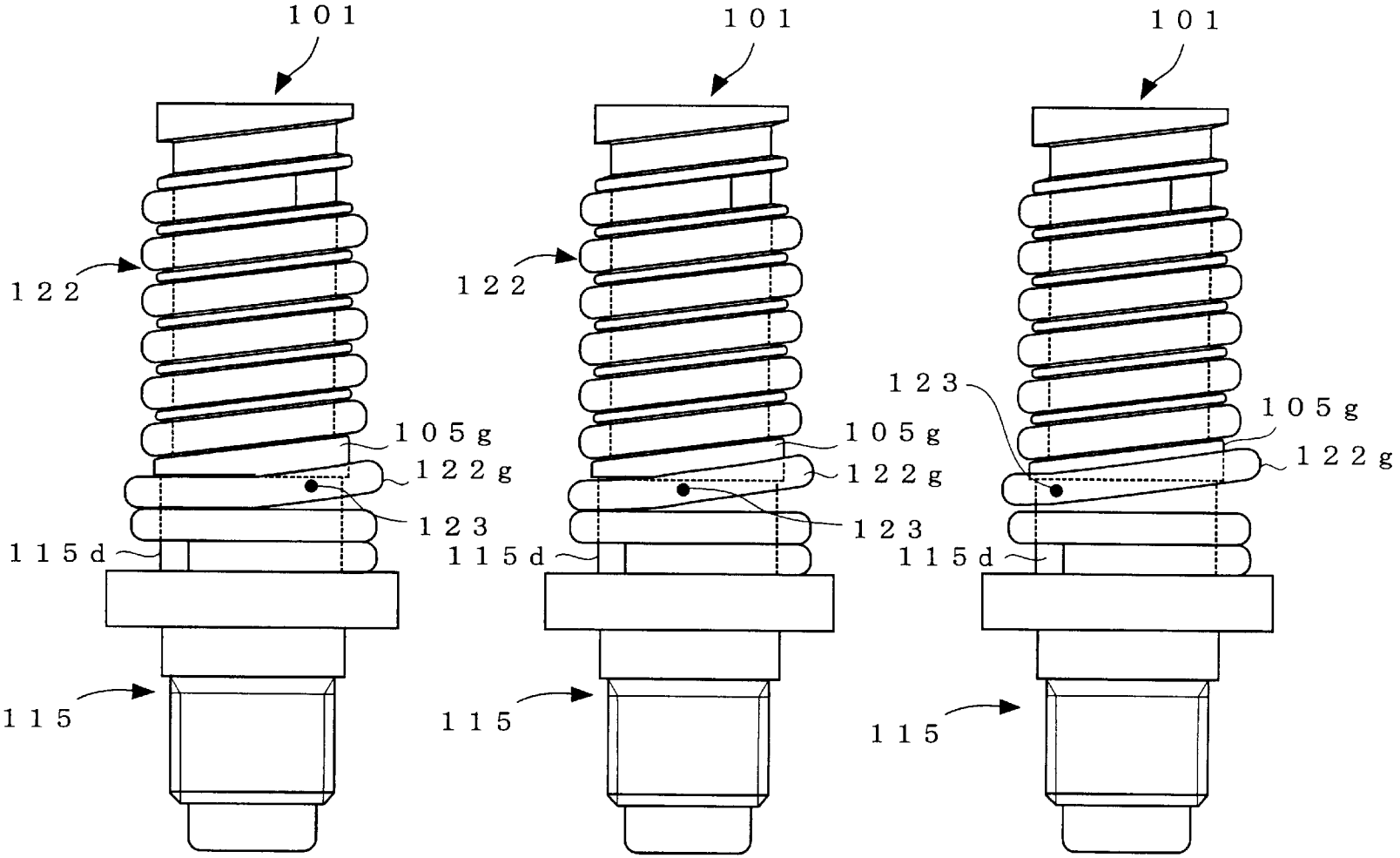
FIG. 11*a* is a drawing illustrating a first contact point between the helical element and the upper cylindrical portion.
FIG. 11*b* is a drawing illustrating a second contact point between the helical element and the upper cylindrical portion.
FIG. 11*c* is a drawing illustrating a third contact point between the helical element and the upper cylindrical portion.

FIGS. 4*a* and 4*b* show the configuration of a first embodiment of a helical antenna in accordance with the present invention. FIG. 4*a* shows the overall configuration of the antenna 1 in the first embodiment of the present invention, and FIG. 4*b* is a cross-sectional view thereof.

As shown in these drawings, a through hole 21*a* is formed in the insulating bobbin 21 (which is made of molded resin), and pierces the bobbin 21 along its axis from top to bottom. This through hole 21*a* serves as a through hole 21*a* for retractably inserting the whip antenna portion. Furthermore, a single thread of helical protrusion portions 25 is formed on the peripheral side surface of the bobbin 21. The helical protrusion portions 25 form a single thread, but for illustrative reasons, the numerals 25*a* to 25*g* are associated with the helical protrusion portions in FIGS. 4*a* and 4*b*. The helical protrusion portion 25*g* is taken as the leading end of the helical protrusion portions 25.

The helical protrusion portions 25*a* to 25*g* form helical groove portions 26 between them, and the helical element 22 is arranged in these helical groove portions 26. The helical element 22 is made of a wire of, for example, phosphor bronze, which is formed into helical shape. The helical element 22 is screwed from the upper end of the bobbin 21 into the helical groove portions 26, which leads to the situation shown in FIGS. 4*a* and 4*b*.

The lower end of the bobbin 21 is provided with a threaded portion, and this threaded portion of the bobbin 21 is screwed into the threaded portion formed on an inner peripheral surface at the upper end of a through hole 15*a* formed in the attachment fitting 15. This fixes the lower end of the bobbin 21 to the attachment fitting 15. The lower portion of the helical element 22 that is screwed onto the bobbin 21 is also wound around an upper cylindrical portion 15*d* formed in the upper portion of the attachment fitting 15, and the helical element 22 is in electrical contact with a second collar portion 15*e* formed at the tip of this upper cylindrical portion 15*d*. Furthermore, the through hole 15*a* formed in the attachment fitting 15 is connected to the through hole 21*a*.

A first collar portion 15*b* is formed in an intermediate portion of the peripheral side surface of the attachment fitting 15, and a threaded portion 15*c* is formed at a lower portion of the peripheral side surface. The threaded portion 15*c* is screwed to the wireless device casing until the lower surface of the first collar portion 15*b* abuts against the wireless device casing. Thus, the attachment portion 15 connects the transmission/reception portion provided inside the wireless device casing with the helical element 22.

In the helical antenna of the first embodiment shown in FIGS. 4*a* and 4*b*, the lower end of the bobbin 21 has substantially the same outer diameter as the second collar portion 15*e* formed on the tip of the attachment fitting 15. Moreover, the depth of the helical groove portion 26*g* formed between the helical protrusion portion 25*f* and the helical protrusion portion 25*g* is shallower than that of the other helical groove portions 26, as shown in FIG. 4*b*. That is to say, the bottom surface of the helical groove portions 26 is gradually raised toward the height of the helical protrusion portion 25*g* serving as the leading end. Thus, when the helical element 22 is screwed into the helical groove portions 26, it is smoothly moved beyond the helical protrusion portion 25*g* and is wound around the upper cylindrical portion 15*d* of the attachment fitting 15. In this case, there is almost no difference in level between the bobbin 21 and the attachment fitting 15, as mentioned above, so that when the helical element 22*g* is screwed into the helical groove portions 26, the position of the helical element 22*g* located near the second collar portion 15*e* is stabilized and is better prevented from shifting vertically. Therefore, the inner peripheral surface of the helical element 22*g* and the peripheral side surface of the second collar portion 15*e* of the attachment fitting 15 are in contact at the stabilized location. Consequently, the effective number of windings of the helical element 22 is stabilized, and shifts of the resonance frequency can be prevented. As mentioned above, the helical element 22 is made of a wire of, for example, phosphor bronze, which is formed into helical shape, so that due to its elasticity, it is in elastic contact with the second collar portion 15*e*.

Figure 5A:
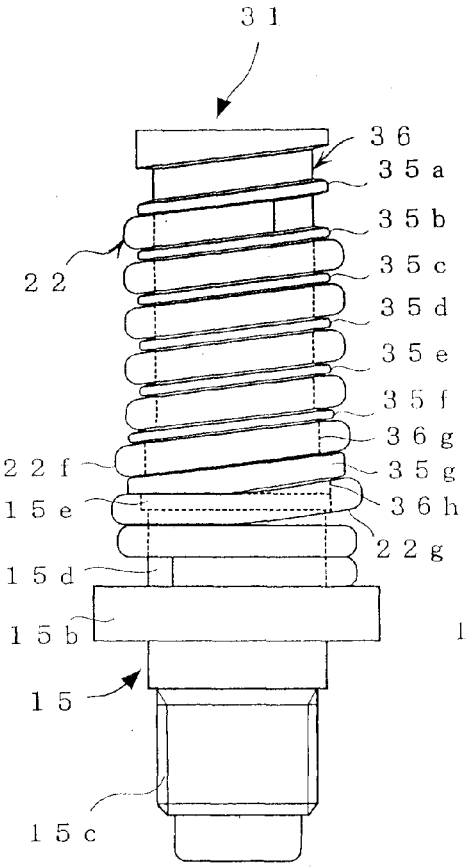
FIG. 5*a* is a plan view showing the configuration of the helical antenna in a second embodiment of the present invention.
Figure 5B:
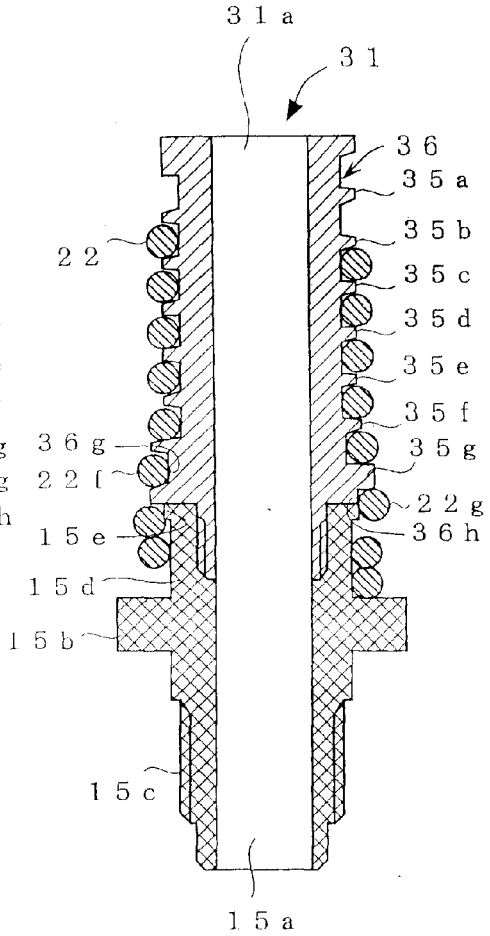
FIG. 5*b* is a cross-sectional view thereof.

In the helical antenna of the first embodiment of the present invention as shown in FIGS. 4*a* and 4*b*, the bottom surface of the helical groove portions 26 is gradually raised toward the height of the helical protrusion portion 25*g* serving as the leading end of the helical protrusion portions 25, so that there is the danger that the position of the helical element 22 located in the shallow groove portion 26*g* shifts. To prevent this, FIGS. 5*a* and 5*b* show the configuration of a helical antenna in a second embodiment of the present invention, in which the helical element 22 does not shift from the groove portion 26, even though the bottom surface of the helical groove portions 26 is gradually raised toward the height of the helical protrusion portion 25*g* serving as the leading end. FIG. 5*a* is a plan view of a helical antenna in the second embodiment of the present invention, and FIG. 5*b* is a cross-sectional view thereof.

Except for the configuration of the helical protrusion portion formed in the peripheral side surface of the bobbin of the helical antenna in the first embodiment, the helical antenna in the second embodiment of the present invention has the same configuration, so that the following explanations relate primarily to this configuration.

As shown in FIGS. 5*a* and 5*b*, a single thread of helical protrusion portions 35 is formed on the peripheral side surface of the insulating bobbin 31, which is made by resin casting. The helical protrusion portions 35 form a single thread, but for illustrative reasons, the numerals 35*a* to 35*g* are associated with the helical protrusion portions in FIGS. 5*a* and 5*b*. The helical protrusion portion 35*g* is taken as the leading end of the helical protrusion portions 35.

The helical protrusion portions 35*a* to 35*g* form helical groove portions 36 between them. The helical groove portion 36 formed between the helical protrusion portions 35*f* and 35*g* is denoted by the numeral 36*g*, and the helical groove portion formed below the helical protrusion portion 35*g* is denoted by the numeral 36h. The helical element 22 is arranged inside the helical groove portions 36. The helical element 22 is made of a wire of, for example, phosphor bronze, which is formed into helical shape. The helical element 22 is screwed from the upper end of the bobbin 31 into the helical groove portions 36, which leads to the situation shown in FIGS. 5*a* and 5*b*.

The lower portion of the helical element 22 that is screwed onto the bobbin 31 is also wound around an upper cylindrical portion 15*d* formed in the upper portion of the attachment fitting 15, and the helical element 22 is in electrical contact with a second collar portion 15*e* formed at the tip of this upper cylindrical portion 15*d*.

As in the helical antenna of the first embodiment, in the helical antenna of the second embodiment shown in FIGS. 5*a* and 5*b*, the bottom surface of the helical groove portions 36 is gradually raised toward the height of the helical protrusion portion 35*g* serving as the leading end. That is to say, the bottom surface of the helical groove portion 36*g* is higher than the bottom surface of the rest of the helical groove portions 36. A characteristic feature of the helical antenna of this second embodiment is that, as shown in the drawings, the helical protrusion portion 35*f* and the helical protrusion portion 35*g* forming the helical groove portion 36*g* are higher than the rest of the helical protrusion portions 35. With this configuration, the depth from the helical protrusion portion 35*g* to the helical groove portion 36*g* is large, and the helical element 22*f* is accommodated securely in the helical groove portion 36*g*. Thus, when the helical element 22 is screwed into the helical groove portions 36, its position is stabilized, and also the effective number of windings of the helical element 22 is stabilized.

Moreover, in the helical antenna of the second embodiment shown in FIGS. 5*a* and 5*b*, due to the helical groove portion 36*h* formed on the lower side of the helical protrusion portion 35*g*, the lower end of the bobbin 31 has substantially the same outer diameter as the second collar portion 15*e* formed on the tip of the attachment fitting 15. Furthermore, the bottom surface of the helical groove portion 36*g* formed between the helical protrusion portions 35*f* and 35*g* is elevated, as shown in FIG. 5*b*. That is to say, the bottom surface of the helical groove portions 36 is gradually raised toward the height of the helical protrusion portion 35*g* serving as the leading end. Thus, when the helical element 22*f* is screwed into the helical groove portions 36, it is smoothly moved beyond the helical protrusion portion 35*g* and is wound around the upper cylindrical portion 15*d* of the attachment fitting 15.

In this case, there is almost no difference in level at the border between the bobbin 31 and the attachment fitting 15, as mentioned above, so that when the helical element 22 is screwed into the helical groove portions 36, the position of the helical element 22*g* located near the second collar portion 15*e* is stabilized and better prevented from shifting vertically. Therefore, the inner peripheral surface of the helical element 22*g* and the peripheral side surface of the second collar portion 15*e* of the attachment fitting 15 are in contact at the stabilized location. Consequently, the effective number of windings of the helical element 22 is stabilized, and shifts of the resonance frequency can be prevented. As mentioned above, the helical element 22 is made of a wire of, for example, phosphor bronze, so that due to its elasticity, it is in elastic contact with the second collar portion 15*e*.

Figure 6:
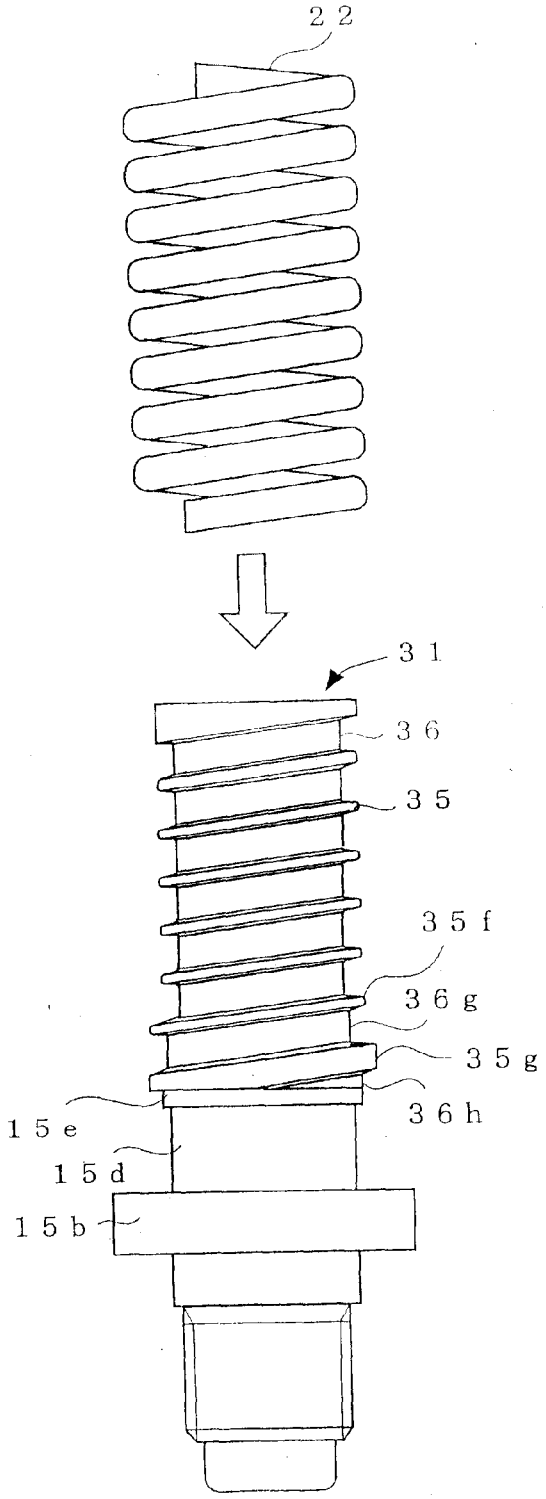
FIG. 6 shows how the helical element of the helical antenna element in the helical antenna of the second embodiment of the present invention is screwed onto the bobbin, whose lower end is screwed to the attachment fitting.

FIG. 6 shows how the helical element 22 of the helical antenna in the second embodiment of the present invention shown in FIGS. 5*a* and 5*b* is screwed onto the bobbin 31, whose lower end has been screwed to the attachment fitting 15. The helical element 22 is made of a wire of, for example, phosphor bronze, which is formed into helical shape, as shown in FIG. 6. The helical element 22 is screwed from the upper end of the bobbin 31 into the helical groove portions 36. The lower end of the helical element 22 passes through the helical groove portion 36*g*, beyond the helical protrusion portion 35*g* serving as the leading end, and is wound around the upper cylindrical portion 15*d* of the attachment fitting 15. Then, the surface of the lower end of the helical element 22 is pressed against the upper surface of the first collar portion 15*b* of the attachment portion 15, which terminates the screwing of the helical element 22. Thus, as mentioned above, the position of the helical element 22 near the second collar portion 15 is stabilized, and the position of the helical element 22 is better prevented from shifting vertically. Consequently, the effective number of windings of the helical element 22 is stabilized, and deviation of the resonance frequency can be prevented.

Figure 7A:
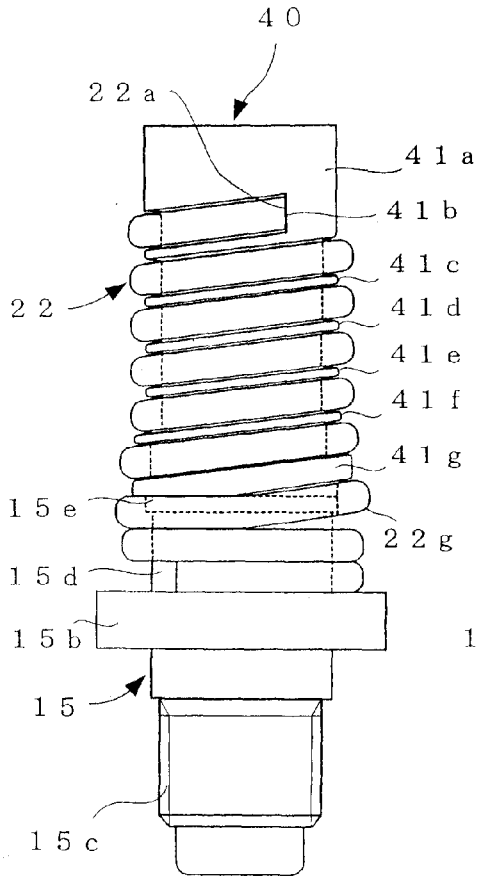
FIG. 7*a* is a plan view showing the configuration of the helical antenna in a third embodiment of the present invention.
Figure 7B:
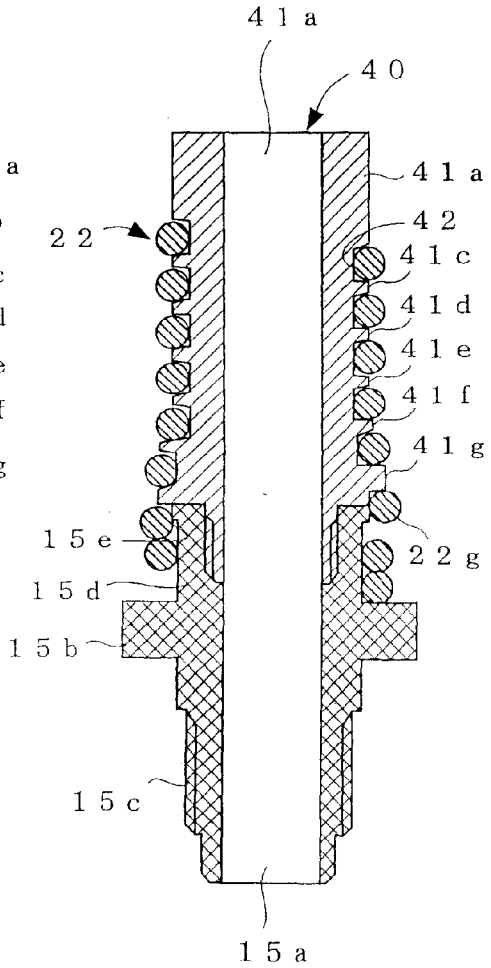
FIG. 7*b* is a cross-sectional view thereof.

In the helical antenna in the second embodiment of the present invention shown in FIGS. 5*a* and 5*b*, the helical element 22 is not positioned with respect to the helical groove portions 36, so that there is the danger that the end of the helical element 22 at which the winding is started is displaced inside the helical groove portions 36. To prevent this, FIGS. 7*a* and 7*b* show the configuration of a helical antenna in a third embodiment of the present invention, in which the end of the helical element 22 at which the winding is started is prevented from being displaced inside the helical groove portions 36. FIG. 7*a* is a plan view of the helical antenna in the third embodiment of the present invention, and FIG. 7*b* is a cross-sectional view thereof.

Except for the configuration of the helical protrusion portions formed in the peripheral side surface of the bobbin of the helical antenna in the second embodiment, the helical antenna in the third embodiment of the present invention has the same configuration, so that the following explanations relate primarily to this configuration.

As shown in FIGS. 7*a* and 7*b*, a single thread of helical protrusion portions 41 is formed on the peripheral side surface of the insulating bobbin 40, which is made of molded resin. The helical protrusion portions 41 form a single thread, but for illustrative reasons, the numerals 41*c* to 41*g* are associated with the helical protrusion portions in FIGS. 7*a* and 7*b*. The helical protrusion portion 41*g* is taken as the leading end of the helical protrusion portions 41. No helical protrusion portion 41 is formed at the upper portion 41*a* of the bobbin 40, and the end surface where the helical protrusion portions 41 break off is indicated by the numeral 41*b*.

The helical protrusion portions 41*c* to 41*g* form helical groove portions 42 between them. The helical element 22 is arranged inside these helical groove portions 42. The helical element 22 is made of a wire of, for example, phosphor bronze, which is formed into helical shape. Before the attachment fitting 15 is screwed on, the helical element 22 is screwed from the lower end of the bobbin 40 into the helical groove portions 42. Then, the bobbin 40, onto which the helical element 22 has been screwed, is screwed to the attachment fitting 15, which leads to the situation shown in FIGS. 7*a* and 7*b*.

When the bobbin 40 is screwed to the attachment fitting 15, a lower portion of the helical element 22 is wound around the upper cylindrical portion 15*d* formed at the top of the attachment fitting 15, and the helical element 22 becomes electrically connected to the second collar portion 15*e*, which is formed at the tip of this upper cylindrical portion 15*d*.

A characteristic feature of the helical antenna of this third embodiment shown in FIGS. 7*a* and 7*b* is that no helical protrusion portion 41 is formed at the upper portion 41*a* of the bobbin 40, but an end surface 41*b* where the helical protrusion portions 41 break off is formed at the upper portion 41*a* of the bobbin 40. Thus, as the helical element 22 is screwed in from the lower end of the bobbin 40, the screwing is terminated when the winding end 22*a* of the helical element 22 abuts against end surface 41*b*. This makes it possible to position the helical element 22 with respect to the helical groove portions 42. That is to say, the winding end 22*a* of the helical element 22 is not displaced inside the helical groove portions 42, so that the effective number of windings of the helical element 22 can be stabilized.

Moreover, as in the helical antenna in the second embodiment, in the helical antenna in the third embodiment shown in FIGS. 7*a* and 7*b*, there is almost no difference in level at the border between the bobbin 40 and the attachment fitting 15, and the position of the helical element 22*g* located near the second collar portion 15*e* is stabilized and better prevented from shifting vertically when the bobbin 40 is screwed to the attachment fitting 15. Therefore, the inner peripheral surface of the helical element 22*g* and the peripheral side surface of the second collar portion 15*e* of the attachment fitting 15 are in contact at the stabilized location. Consequently, the effective number of windings of the helical element 22 is stabilized, and shifts of the resonance frequency can be prevented. As mentioned above, the helical element 22 is made of a wire of, for example, phosphor bronze, so that due to its elasticity, it is in elastic contact with the second collar portion 15*e*.

Figure 8:
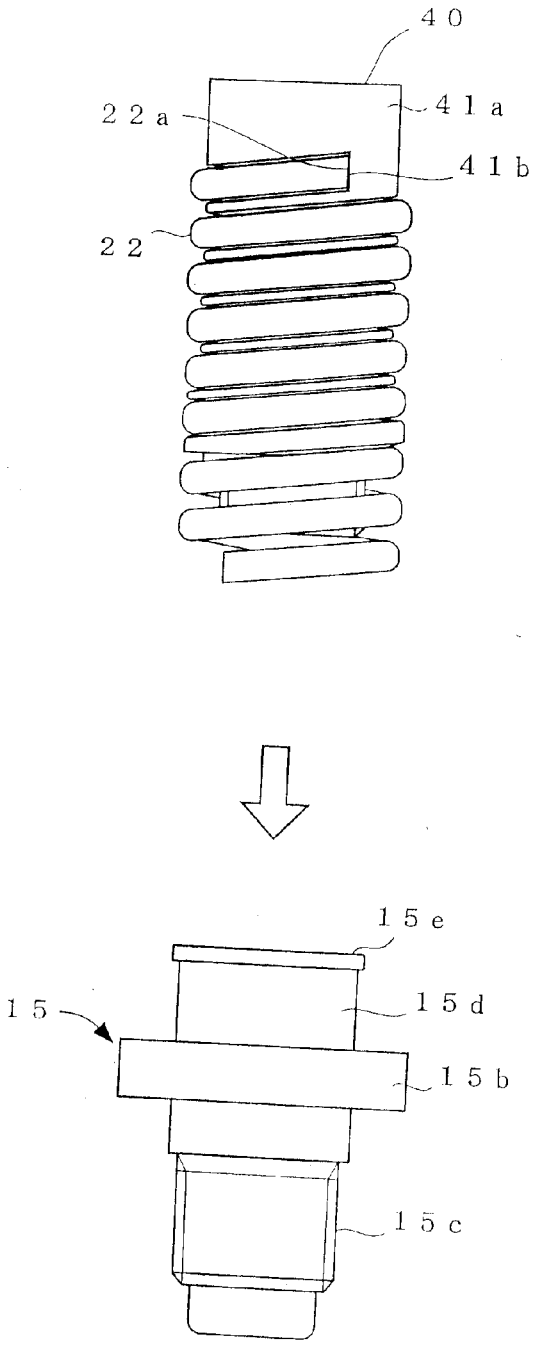
FIG. 8 shows how, in the helical antenna of the third embodiment of the present invention, the bobbin to which the helical element has been screwed, is screwed onto the upper end of the attachment fitting.

FIG. 8 shows how, in the third embodiment of the present invention, shown in FIGS. 7*a* and 7*b*, the bobbin 40, to which the helical element 22 has been screwed, is screwed onto the upper end of the attachment fitting 15. The helical element 22 is made of a wire of, for example, phosphor bronze, which is formed into helical shape, as shown in FIG. 8. The helical element 22 is screwed from the lower end of the bobbin 40 into the helical groove portions 42. The bobbin 40 is then manually screwed from the top onto the attachment fitting 15. The lower end of the helical element 22 passes over the second collar portion 15*e* of the attachment fitting 15, and is wound around the upper cylindrical portion 15*d* of the attachment fitting 15. Then, the surface of the lower end of the helical element 22 is pressed against the upper surface of the first collar portion 15*b* of the attachment portion 15, terminating the screwing of the bobbin 40 onto the attachment fitting 15. Thus, as mentioned above, the winding end 22*a* of the helical element 22 abuts against the end surface 41*b* of the helical protrusion portions 41, and the position of the helical element 22 near the second collar portion 15 is stabilized. Consequently, the effective number of windings of the helical element 22 is stabilized, and deviation of the resonance frequency can be prevented.

The helical antennas of the first to third embodiment of the present invention as described above can be used as helical antenna portions 11 in antennas as shown in FIGS. 1*a*, 1*b*, 2*a* and 2*b*. In variations, they also can be used for antennas with other configurations. Examples of antenna configuration in which such variations are used are shown in FIGS. 9*a*, 9*b*, and 9*c*.

Figure 9A:
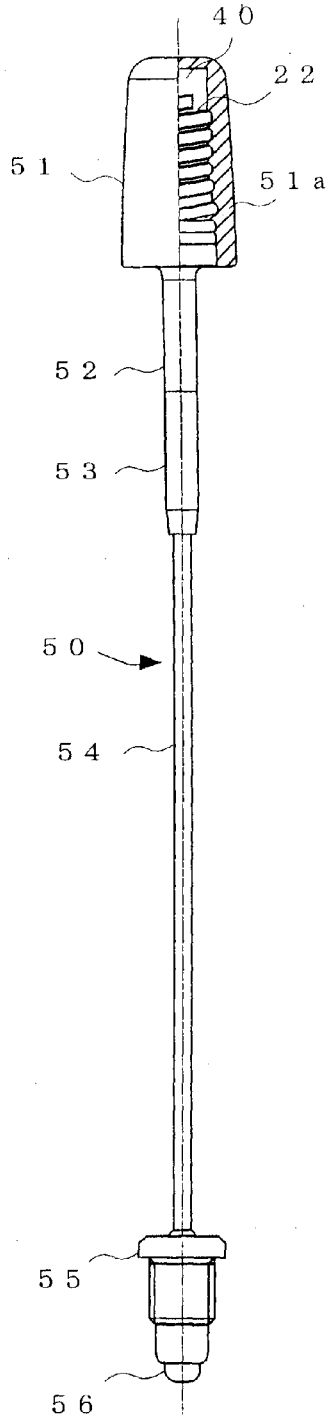
FIG. 9*a* shows an example, in which a helical antenna in accordance with the present invention is used as the retractable antenna for a mobile telephone.
Figure 9B:
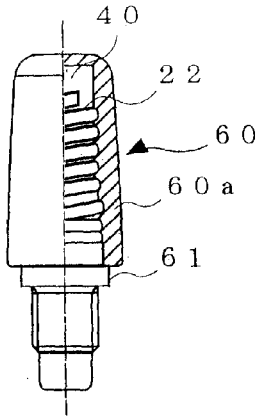
FIG. 9*b* shows an example, in which a helical antenna in accordance with the present invention is used as an antenna that includes only a helical antenna portion.
Figure 9C:
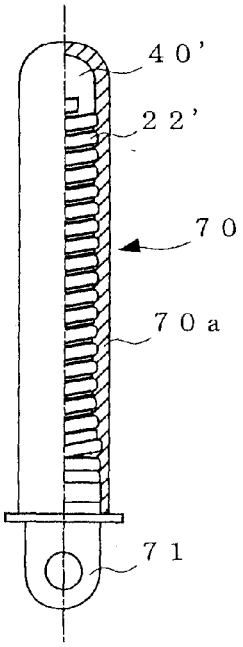
FIG. 9*c* shows an example, in which a helical antenna in accordance with the present invention is used as an antenna for a lower frequency band that includes only a helical antenna portion.
Figure 10A:
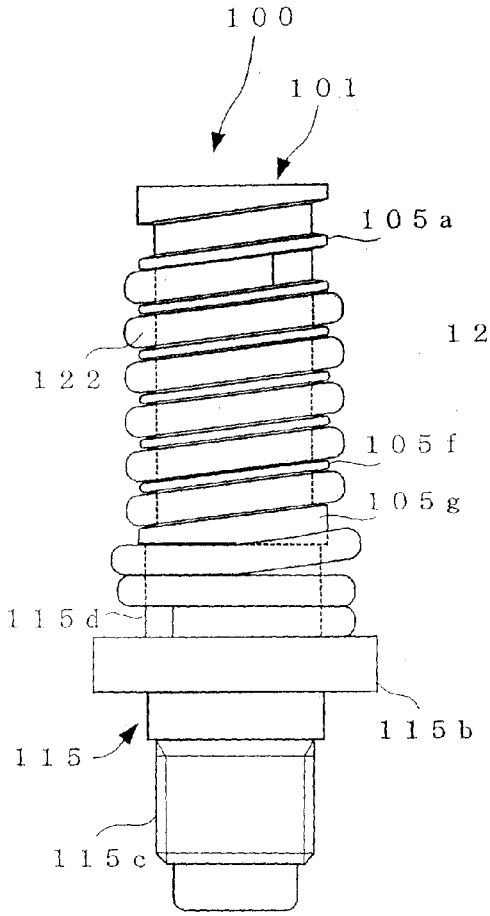
Figure 10B:
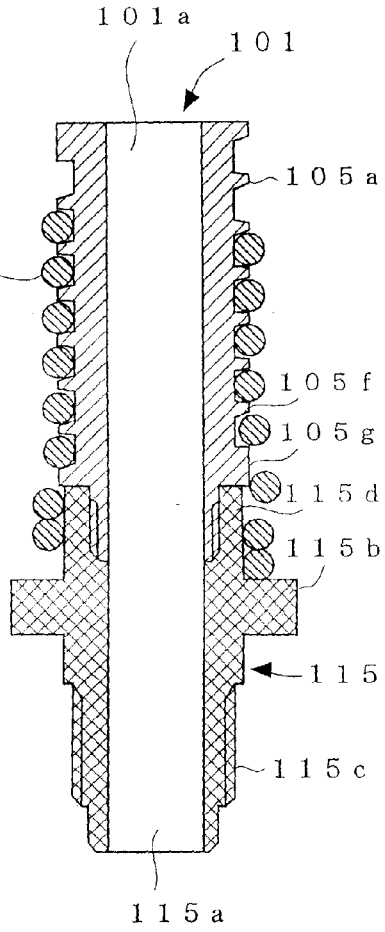
Figures 11A, 11B, 11C:
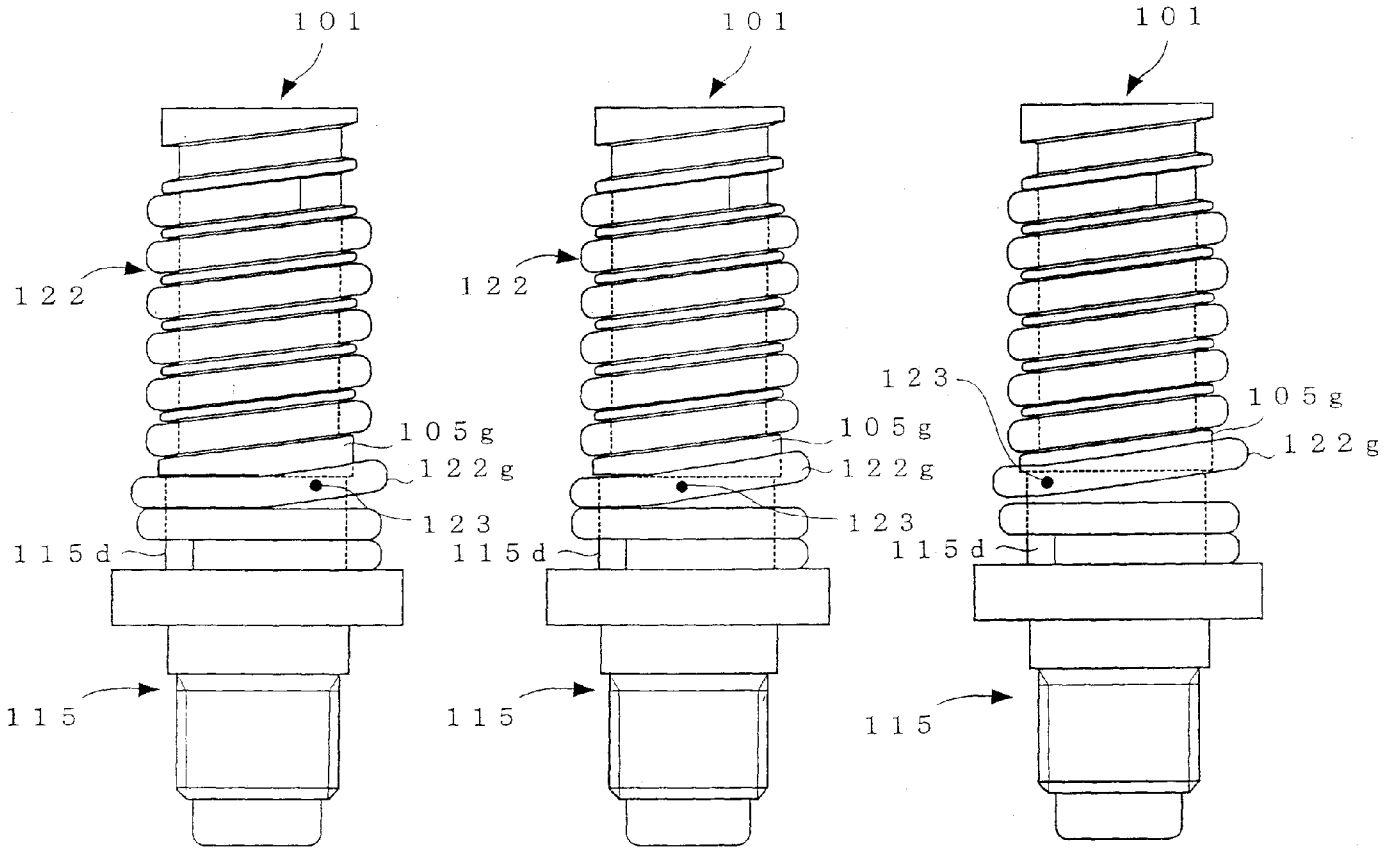

The antenna 50 shown in FIG. 9*a* can be used as a retractable antenna for a mobile telephone. As shown in FIG. 9*a*, the antenna 50 includes an antenna element made of a helical antenna portion 51 and a whip antenna portion 54. The whip antenna portion 54 is slidable inside the attachment fitting 55. That is to say, pulling the whip antenna portion 54 out of the attachment fitting 55, a stopper portion 56 provided at the lower end of the whip antenna portion 54 engages with the lower end of the attachment fitting 55, as shown in FIG. 9*a*, so that the stopper portion 56 stays inside the attachment fitting 55. Thus, the stopper portion 56 electrically connects the whip antenna portion 54 with the attachment fitting 55, and the whip antenna portion 54 functions as an antenna.

When the whip antenna portion 54 is stowed away behind the attachment fitting 55, an insulating joint portion 53 provided at the upper end of the whip antenna portion 54 and a pipe-shaped sleeve fitting 52, into which the upper portion of the joint portion 53 is inserted, are held inside the attachment fitting 55. Thus, the sleeve fitting 52 electrically connects the helical antenna portion 51 with the attachment fitting 55, and the helical antenna portion 51 functions as an antenna. The joint portion 53 insulates the whip antenna portion 54 and the helical antenna portion 51 from one another.

The helical antenna portion of the third embodiment described above is used for the helical antenna portion 51, and the helical element 22 wound around the bobbin 40 is electrically connected to the sleeve fitting 52. Furthermore, a cover portion 51*a* is formed so that it covers the bobbin 40 and the helical element 22, and taken as the helical antenna portion 51. In this helical antenna portion 51, it is not necessary to form a through hole in the bobbin 40.

In the antenna 60 shown in FIG. 9*b*, the antenna 60 includes only a helical antenna portion. Also in this antenna 60, the helical antenna portion of the third embodiment described above is used, and the helical element 22 wound around the bobbin 40 is electrically connected to the attachment fitting 61. Furthermore, a cover portion 60*a* is formed so that it covers the bobbin 40 and the helical element 22, and taken as the helical antenna 60. Again, it is not necessary to form a through hole in the bobbin 40 or in the attachment fitting 61.

Also in the antenna 70 shown in FIG. 9*c*, the antenna 70 includes only a helical antenna portion. In this antenna 70, the used frequency band is lower than in the antenna 60 shown in FIG. 9*b*, and the antenna 70 uses the helical antenna of the above-described third embodiment of the present invention. Therefore, it is provided with a lengthy bobbin 40' and the effective number of windings of the helical element 22' wound around the bobbin 40' is larger. The antenna 70 is attached by forming, in addition to a threaded portion, a flat portion in the lower portion of the attachment fitting 71, which is electrically connected to the helical element 22, and inserting an attachment screw into the attachment hole formed in the flat portion. Furthermore, a cover portion 60*a* covering the bobbin 40' and the helical element 22' is formed and is taken as the antenna 70. Again, it is not necessary to form a through hole in the bobbin 40' or in the attachment fitting 71.

It is also possible to use the helical antenna of the first embodiment or the helical antenna of the second embodiment for the antennas 50, 60 and 70 shown in FIGS. 9*a* to 9*c*.

In the helical antennas of the first to third embodiments, the resin material for the bobbin can be, for example, an ABS resin, and the attachment fitting can be made, for example, of brass.

In accordance with the present invention as described above, the leading end of the helical protrusion portions formed on the lower end of the bobbin has substantially the same diameter as the second collar portion of the attachment fitting connected to this leading end, and the depth of the helical groove portion becomes gradually shallower than toward this leading end, so that the helical element moves easily beyond the leading end onto the side surface of the second collar portion. Since the diameter of the second collar portion and the diameter of the leading end are substantially the same and there is almost no difference in level between them, the helical element is better prevented from shifting vertically, and the helical element contacts the side surface of the second collar portion of the attachment fitting at a stabilized location. Consequently, variations of the resonance point can be prevented.

Furthermore, when the helical protrusion portions including the leading end, which form the helical groove portion whose depth becomes shallower, are formed higher, then this helical groove portion becomes deeper, and the position of the helical element within this groove portion is stabilized, so that the position of the helical element at the border between the bobbin and the attachment fitting is stabilized, and the position where the helical element contacts the attachment fitting is stabilized even better.

Furthermore, when the helical groove portion breaks off in an upper portion of the bobbin, and the helical element is screwed onto the bobbin from below until the upper end surface of the helical element abuts against the abutting portion where the helical groove portion breaks off, the bobbin can be screwed into the attachment fitting. Then, when the bobbin is being screwed into the attachment fitting, the upper end surface of the helical element is fixed by abutting against the abutting portion, so that the position where the helical element contacts the attachment fitting is stabilized even better, and variations of the resonance point can be prevented even better.

What is claimed is:

1. A helical antenna, at least comprising:

a bobbin having a peripheral side surface in which helical protrusion portions are formed, thereby forming helical groove portions between the protrusion portions;

an attachment fitting provided with a first collar portion at an intermediate portion of the attachment fitting and with a second collar portion at an end of the attachment fitting, the attachment fitting being attached to a lower end of the bobbin; and a helical element screwed into the helical groove portions, so that a lower surface of the helical element contacts the first collar portion;

a leading end of the helical protrusion portions formed at the lower end of the bobbin has substantially the same outer diameter as the second collar portion, which is connected to this leading end; and a depth of the helical groove portions becomes gradually shallower toward the leading end of the helical protrusion portions;

wherein the inner peripheral surface of the helical element beyond the leading end is in contact with a side surface of the second collar portion.

2. The helical antenna of claim 1, wherein the helical protrusion portions located on both sides of the helical groove portion whose depth becomes gradually shallower are formed higher.

3. The helical antenna of claim 1, wherein the helical groove portion in an upper portion of the bobbin breaks off, forming an abutting portion, and an upper end surface of the helical element is abutted against this abutting portion.

4. The helical antenna of claim 1, wherein a through hole is formed along an axis of the bobbin and the attachment fitting, and a whip antenna portion and an insulating joint portion provided integrally with an upper end of the whip antenna portion are arranged slidably inside this through hole.

* * * * *

UNITED STATES PATENT AND TRADEMARK OFFICE

CERTIFICATE OF CORRECTION

PATENT NO. : 6,346,926 B1
DATED : February 12, 2002
INVENTOR(S) : Masataka Shimabara et al.

It is certified that error appears in the above-identified patent and that said Letters Patent is hereby corrected as shown below:

Delete the title page and insert therefore the attached title page.

Delete Drawing Sheets 1-11 and insert therefore Drawing Sheets 1-11.

Signed and Sealed this

Thirtieth Day of December, 2003

JAMES E. ROGAN
*Director of the United States Patent and Trademark Office*

(12) United States Patent
Shimabara et al.

(10) Patent No.: US 6,346,926 B1
(45) Date of Patent: Feb. 12, 2002

(54) HELICAL ANTENNA

(75) Inventors: Masataka Shimabara, Warabi; Yutaka Izumi; Takashi Nakaya, both of Kounosu, all of (JP)

(73) Assignee: Nippon Antena Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/697,141

(22) Filed: Oct. 27, 2000

(30) Foreign Application Priority Data

Oct. 29, 1999 (JP) ..... 11-308771

(51) Int. Cl.[7] ..... H01Q 1/36

(52) U.S. Cl. ..... 343/895

(58) Field of Search ..... 343/895, 715, 343/749, 702; H01Q 1/36

(56) References Cited

U.S. PATENT DOCUMENTS 6,239,768 B1 * 5/2001 Oh et al. ..... 343/895

* cited by examiner

*Primary Examiner*—Michael C. Wimer
(74) *Attorney, Agent, or Firm*—Connolly Bove Lodge & Hutz

(57) ABSTRACT

Helical protrusion portions are formed on a peripheral side surface face of a bobbin, and a helical element is screwed into the helical grooves formed between the helical protrusion portions. The lower end of the bobbing is screwed onto an attachment fitting provided with a first collar portion at an intermediate portion and a second collar portion at the end. The depth of the helical groove portions becomes gradually shallower toward the leading end of the helical protrusion portions, and the helical protrusion portions formed on the lower end of the bobbin are formed higher, so that the position of the helical element is stabilized. Thus, deviation of the resonance point of the helical element can be prevented.

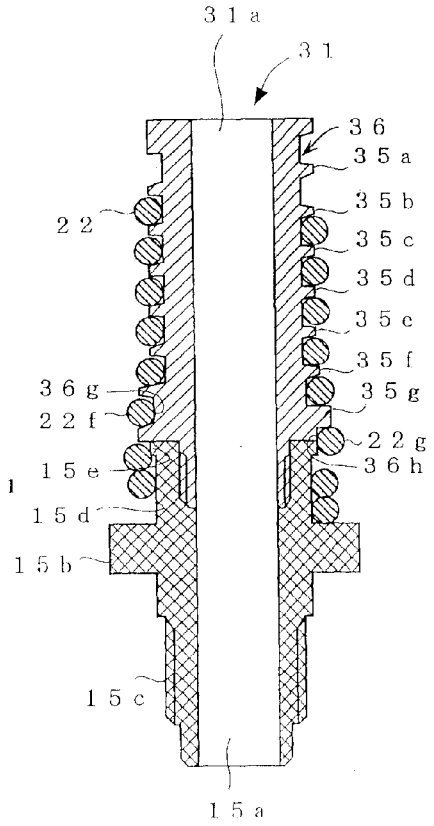

4 Claims, 11 Drawing Sheets